US008640395B2

(12) United States Patent
DiSabantonio, III

(10) Patent No.: US 8,640,395 B2
(45) Date of Patent: Feb. 4, 2014

(54) PORTABLE PASSIVE ANTI-CORROSION VEHICLE ENCLOSURE

(76) Inventor: Joseph J. DiSabantonio, III, Naples, FL (US)

( * ) Notice: Subject to any disclaimer, the term of this patent is extended or adjusted under 35 U.S.C. 154(b) by 54 days.

(21) Appl. No.: 13/463,229

(22) Filed: May 3, 2012

(65) Prior Publication Data

US 2012/0216844 A1 Aug. 30, 2012

Related U.S. Application Data

(63) Continuation-in-part of application No. 12/950,986, filed on Nov. 19, 2010, now abandoned.

(51) Int. Cl.
*E04H 1/00* (2006.01)
*E04C 2/32* (2006.01)

(52) U.S. Cl.
CPC ..... *E04C 2/322* (2013.01)
USPC ..... 52/79.5; 135/117; 135/137

(58) Field of Classification Search
USPC ..... 52/474, 483.1, DIG. 12, DIG. 14, 3, 52/79.1, 79.5, 174, 175, 176; 135/115, 135/117, 119, 132, 137
See application file for complete search history.

(56) References Cited

U.S. PATENT DOCUMENTS 2,755,811 A * 7/1956 Murray ..... 135/123
2,817,344 A * 12/1957 Teeter ..... 135/129
2,956,941 A * 10/1960 Heath et al. ..... 204/157.63
3,277,621 A * 10/1966 Merdich ..... 52/86
3,463,174 A * 8/1969 Heller ..... 135/143
3,749,107 A * 7/1973 Laberge ..... 135/137
3,827,019 A * 7/1974 Serbu ..... 335/285
4,231,289 A * 11/1980 Domicent ..... 454/52
4,306,390 A 12/1981 Brown
4,683,902 A 8/1987 Wilson
4,844,109 A * 7/1989 Navarro ..... 135/129
4,944,321 A * 7/1990 Moyet-Ortiz ..... 135/88.06
5,493,818 A * 2/1996 Wilson ..... 52/71
5,954,200 A * 9/1999 Allain et al. ..... 206/335
6,029,404 A * 2/2000 Lewis ..... 52/2.18
6,192,909 B1 * 2/2001 Strausser ..... 135/137
6,196,242 B1 * 3/2001 Xu ..... 135/20.1
6,220,263 B1 4/2001 Randmae (Continued)

OTHER PUBLICATIONS

High Performance VpCI Packaging, VpCI-126 Blue, Cortec Corporation, Aug. 5, 2007, St. Paul, US.

(Continued)

*Primary Examiner* — William Gilbert
*Assistant Examiner* — Gisele Ford
(74) *Attorney, Agent, or Firm* — Tracy Jong Law Firm; Tracy P. Jong; Cheng Ning Jong

(57) ABSTRACT

A portable passive anti-corrosion vehicle enclosure comprising a support frame system and a flexible enclosure. The support frame system is disposed within the flexible enclosure. The flexible enclosure comprises a floor sheet, a side sheet and a ceiling sheet, where the side and ceiling sheets are supported by the support frame system. The flexible enclosure further comprises a closure means configured for enabling entry and exit of a vehicle and/or a driver. When the vehicle enclosure is erected and sealed, the volume defined by the support frame system is substantially isolated from its surrounding environment. A non-powered passive corrosion protection means is provided within the volume to eliminate or reduce corrosion of exposed vehicle metal components within the volume.

18 Claims, 18 Drawing Sheets

(56) References Cited

U.S. PATENT DOCUMENTS

| | | | | |
|---|---|---|---|---|
| 6,341,451 | B1 * | 1/2002 | Morton, Sr. | 52/64 |
| 6,349,732 | B1 | 2/2002 | Cooper | |
| 6,371,144 | B1 * | 4/2002 | Ragatz | 135/156 |
| 6,439,384 | B2 | 8/2002 | Martin | |
| 6,439,645 | B1 | 8/2002 | Pedersen | |
| 6,701,948 | B2 * | 3/2004 | Jopp et al. | 135/97 |
| 7,740,022 | B2 * | 6/2010 | Li | 135/87 |
| 8,171,947 | B2 * | 5/2012 | Hardie | 135/129 |
| 8,418,757 | B2 * | 4/2013 | Lyublinski et al. | 166/162 |
| 2004/0234790 | A1 * | 11/2004 | Smith et al. | 428/457 |
| 2006/0043760 | A1 | 3/2006 | Millward | |

OTHER PUBLICATIONS

Bob Berg, Material Safety Data Sheet, Cortec Corporation, Dec. 1, 2006, St. Paul, US.

MiniTec Framing Systems, LLC, MiniTec T-Slotted Aluminum Extrusions, 2009, Victor, US.

BluGuard-VCI-Clear Anti-Corrosion Barrier Lamination, Volatile Corrosion Inhibitors, 2009, Victor, US.

* cited by examiner

PORTABLE PASSIVE ANTI-CORROSION VEHICLE ENCLOSURE

PRIORITY CLAIM AND RELATED APPLICATIONS

This continuation-in-part application claims the benefit of priority from non-provisional application U.S. Ser. No. 12/950,986 filed Nov. 19, 2010. Said application is incorporated by reference in its entirety.

BACKGROUND OF THE INVENTION

1. The Field of the Invention

The present invention is directed generally to a vehicle enclosure, and more particularly, to a portable passive anti-corrosion vehicle enclosure that is capable of enveloping a vehicle it its entirety without coming into direct contact with the vehicle it encloses.

2. Background Art

Conventional car covers are made of combinations of fabrics or non-wovens that are designed to protect the finish of a vehicle from scratching, rubbing and other detrimental effects of coming in contact with moisture and other objects. However, when a conventional cover is draped over a vehicle, the underside of the vehicle is left completely exposed to corrosion and pest intrusion (e.g., rodents and insects).

In order to address the above shortcoming, various solutions have been developed to fully enclose a vehicle. U.S. Pat. No. 6,220,263 to Randmae discloses an inflatable protective fabric enclosure for an automobile. However, it requires a blower to fully inflate the enclosure. Consequently, if the blower is not operating or fails, the front and rear portions of the enclosure are not supported and will droop down to contact the vehicle parked inside the enclosure. There is an even more significant drawback to this invention. Actively supporting the enclosure with a blower not only wastes electric power, but also increases the manufacturing and maintenance costs of the enclosure. The '263 design has yet other drawbacks. It is impossible to avoid contact of the enclosure with a vehicle parked on the fabric when the enclosure is being erected and taken down since the front and rear portions of the enclosure are not structurally supported while being erected or taken down. The enclosure may not be conveniently used since at least a portion of the side walls must be removed before a vehicle can be driven in or out of the enclosure. Another drawback lies in the lack of corrosion protection within the enclosure. In fact, corrosion tendency of vehicle components stored in such an enclosure may increase.

US Pat. App. Pub. No. 2006/0043760 discloses a vehicle cover having two cover members where one pivots relative to the other to move between the open and closed positions of the cover. The cover includes a base on which two cover members are mounted. After one of the cover members is pivoted relative to the other, full access is provided to the vehicle. One drawback of this configuration lies in the large amount of space required for each cover member and the difficulty this presents during transport. Additionally, since one of the covers is pivoted in use, the arch traversed by the cover member is large, thereby requiring a tall ceiling for clearance. In the case of a large vehicle, the size of the cover members may be prohibitively large.

Vehicle appearance has become increasingly important as a tool to convey one's status in the society. Therefore it is important to most people to keep their vehicles in not only good mechanical condition but also in superb appearance. Luxury, antique or custom vehicles are typically well cared for by their owners with car washes, waxing and other buffing work. However, most of these cars are simply parked and stored in an environmentally controlled or worse yet non-temperature controlled garages upon application of exterior finishing. Many conventional covers are simply too cumbersome and unattractive to utilize, thereby deterring more widespread use of the conventional covers. Conventional car covers designed to cover only the vehicle body are typically made of woven textiles are generally opaque and dyed to certain colors. Under these circumstances, it is not possible to protect a vehicle with such a cover while still showcasing it.

Thus, there exists a need for a vehicle enclosure capable of isolating a vehicle from its environment that can be readily used, is relatively compact for storage and handling, and requires minimal work to store or retrieve a vehicle. There further exists a need for a vehicle enclosure which provides corrosion protection to a vehicle it encloses. There further exists a need for a vehicle enclosure that is at least semi-transparent to enable visual enjoyment or identification of the vehicle it protects.

SUMMARY OF THE INVENTION

The present invention discloses a portable passive anti-corrosion vehicle enclosure comprising a support frame system defining a volume and a flexible enclosure. The flexible enclosure comprises a floor sheet having a periphery, a closed ended side sheet having a top periphery and a bottom periphery, a ceiling sheet having a periphery and a closing means. The side sheet is fixedly attached at the bottom periphery to the floor sheet periphery. The side sheet is fixedly attached at the top periphery to the ceiling sheet periphery. The closing means is disposed on a portion of the side sheet at an offset from the floor sheet and substantially parallelly from the floor sheet periphery. The support frame system comprises a bottom frame capable of being sized to accommodate the vehicle, a plurality of vertically disposed posts, a plurality of support bars where each bar is secured at each end to a top end of one of the plurality of vertically disposed posts and at least one weigh down plate secured to the bottom frame. In one embodiment, the closing means is a waterproof zipper.

Each vertically disposed post includes a top end and a bottom end and is secured at its bottom end to the bottom frame. A number of the vertically disposed posts are capable of position adjustment along the bottom frame.

The weigh down plates are capable of position adjustment along the bottom frame and configured to be disposed under at least a portion of the vehicle weight for aiding in securing the support frame system.

The support frame system is disposed within and configured for supporting the flexible enclosure and the closing means is configured to enclose the volume to isolate the volume from its surrounding environment and that no part of the vehicle enclosure comes in contacting engagement with the body of the vehicle, thereby not compromising the finish of the body of the vehicle.

Each distal weigh down plate further comprises a lip disposed at one edge of the weigh down plate where the lip is configured to mark a travel limit for the vehicle positioned inside the vehicle enclosure such that the vehicle can be properly positioned on the weigh down plates.

Each proximal vertically disposed post further comprises a concave surface configured to receive a portion of the flexible enclosure below the closing means to avoid tensioning of the flexible enclosure when a vehicle enters the volume.

The flexible enclosure is preferably impregnated with vapor phase corrosion inhibitor (VPCI). In use, upon erecting the present enclosure, a driver simply drives a vehicle into the volume defined by the support frame system. The side and ceiling sheets of the flexible enclosure are then brought over support frame system before the closing means of the side sheet is closed to isolate the volume such that VPCI materials may proceed to work. In one embodiment, at least one individual packet containing and capable of releasing VPCI materials is disposed in the volume to further increase the concentration of VPCI materials within the volume, thereby enhancing corrosion protection within the volume.

It is a primary object of the present invention to provide a protective vehicle enclosure that does not come in direct contact with the body of a vehicle it protects, thereby not inadvertently causing damage to the finish of the body of the vehicle.

It is another object of the present invention to provide a protective vehicle enclosure that incorporates a passive corrosion protection means.

It is yet another object of the present invention to provide a protective vehicle enclosure that substantially fully enclose a vehicle it protects, thereby providing protection against intrusion of small animals and larger insects.

It is yet another object of the present invention to provide a protective vehicle enclosure that is collapsible and easily transportable.

It is yet another object of the present invention to provide a closing means that is elevated from a floor upon which the vehicle enclosure is disposed to reduce the possibility of animal, insect and moisture intrusions.

It is yet another object of the present invention to provide weigh down plates which aid in providing stability of the support frame system relative to the vehicle it accommodates.

Whereas there may be many embodiments of the present invention, each embodiment may meet one or more of the foregoing recited objects in any combination. It is not intended that each embodiment will necessarily meet each objective. Thus, having broadly outlined the more important features of the present invention in order that the detailed description thereof may be better understood, and that the present contribution to the art may be better appreciated, there are, of course, additional features of the present invention that will be described herein and will form a part of the subject matter of this specification.

In this respect, before explaining at least one embodiment of the invention in detail, it is to be understood that the invention is not limited in its application to the details of construction and the arrangements of the components set forth in the following description or illustrated in the drawings. The present invention is capable of other embodiments and of being practiced and carried out in various ways. Also it is to be understood that the phraseology and terminology employed herein are for the purpose of description and should not be regarded as limiting.

BRIEF DESCRIPTION OF THE DRAWINGS

In order that the manner in which the above-recited and other advantages and objects of the invention are obtained, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

PARTS LIST

Figure 1:
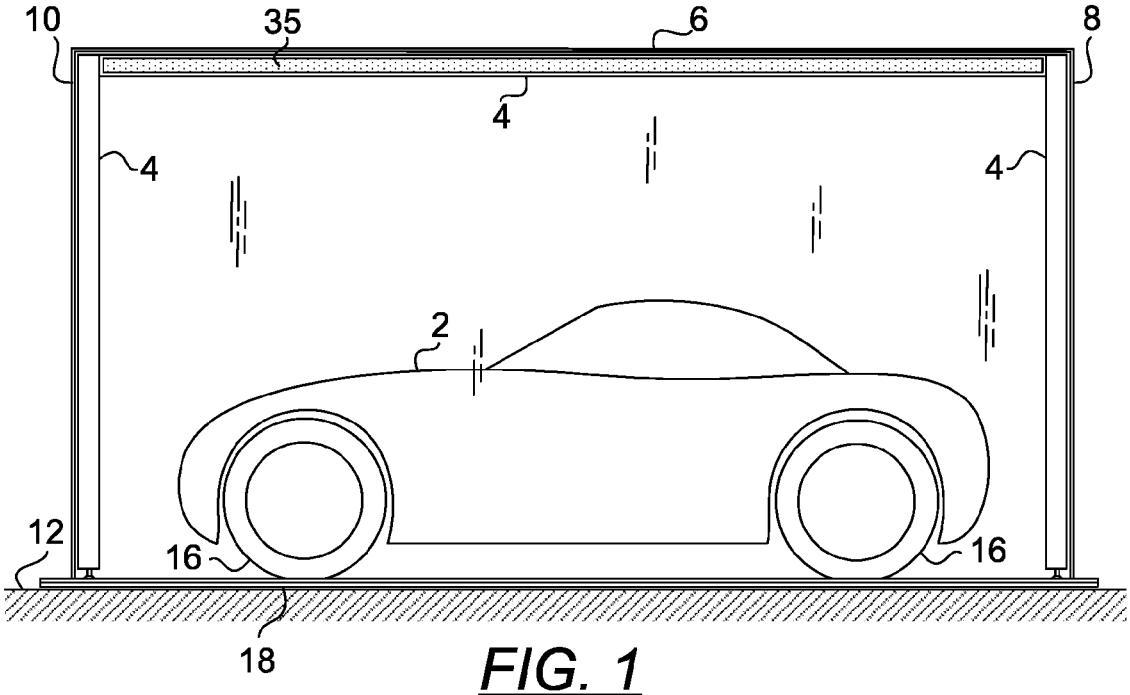
FIG. 1 is a side orthogonal view of a vehicle stored in a vehicle enclosure according to the present invention.

2—vehicle
4—support member
6—vehicle enclosure
8—front of vehicle enclosure
10—rear of vehicle enclosure
12—floor
16—tire
18—floor sheet
20—floor sheet magnet strip
22—door frame magnet strip
24—enclosing sheet
26—doorway fringe
27—opening of enclosing sheet
28—enclosing sheet magnet strip
29—door fringe magnet strip
30—door threshold magnet strip
31—bend of door panel
32—door panel magnet strip
33—side door frame magnet strip
34—door panel
35—hanger magnet strip
36—level adjuster
37—side door threshold magnet strip
38—corner
39—side door panel magnet strip
40—bend of enclosing sheet
42, 43—seam
44—corner of enclosing sheet
46—corner of floor sheet
48, 50, 52, 54—pocket
56—flap
58—width of doorway fringe
60—strip
62—cross support member
64—side door panel
66—side door panel frame
68—side doorway fringe
70—vehicle door
72—side opening
73—vehicle enclosure
74—flexible enclosure
76—closing means
78—offset of closing means from floor
80—closing means end
81—support frame system
82—proximal post
84—distal post
86—medial post
88—side and corner frame
90—side extension frame
92—extension block
94—proximal cross bar
96—distal cross bar
98—proximal weigh down plate
100—distal weigh down plate
102—side channel
104—corner channel
106—flat portion
108—lip portion
110—connecting plate
112—aperture
114—location where side and corner frames meet
116—longitudinal end of extension block
118—vertical portion of proximal post
120—inclined portion of proximal post
122—G pin
124—inserted portion of G pin
126—locking portion of G pin
128—bar connecting inserted and locking portions of G pin
130—top support bar
132—end connector of proximal cross bar
134—floor sheet
136—side sheet
138—ceiling sheet
140—proximal end of vehicle enclosure

PARTICULAR ADVANTAGES OF THE INVENTION

The present invention provides a vehicle enclosure that is capable of enclosing a vehicle in its entirety. In one embodiment, the non-contact nature of the present invention relative to the body of a vehicle eliminates the potential of causing scratches and buff marks on exterior surfaces of the vehicle, as well as soiling on difficult-to-clean large vehicle enclosures.

Prior art non-contact collapsible enclosures unadvantageously use blowers to keep such enclosures erected, thereby increasing ownership and operating costs. In contrast to prior art non-contact vehicle enclosure, the present invention requires no power to maintain the enclosure from collapsing.

The use of a floor sheet of an overall flexible enclosure protects the vehicle from moisture that migrates upward into chassis, brakes, cables and other susceptible components of the vehicle. Ingress of moisture into a component can cause corrosion which reduces structural integrity of the component and in some cases cause electrical shorts. In addition to corrosion protection, the complete enclosure of the vehicle keeps out rodents and insects, eliminating the need for pest deterrents or pest control substances such as moth balls, poison and the like. The positioning of the closing means at an offset from the floor further prevents animal, insect and moisture intrusions.

The present vehicle enclosure eliminates the necessity of repeatedly erecting a deconstructing the enclosure each time a vehicle enters and exits. Unlike a conventional vehicle cover, complete removal of the enclosure is neither necessary nor desirable when temporary access to the vehicle is desired. In the present invention, a support frame system is erected over a floor sheet and enclosed within a flexible enclosure. In order to access the vehicle stored inside the present invention, one simply has to unzip the closing means or zipper and fold back the side and ceiling sheets.

The flexible enclosure is constructed from a VPCI impregnated material. In use, VPCI modules are naturally dispersed from the interior surfaces of the flexible enclosure and have affinity for ferrous as well as non-ferrous metal surfaces of the vehicle, preventing moisture and oxygen from becoming attached to the surfaces which would otherwise cause rust to develop and soiling to occur. The outer layer of the flexible enclosure comprises Polyethylene Terephthalate (PET), thereby providing excellent moisture and oxygen barrier from the surrounding environment. The flexible enclosure is sufficiently thick to prevent wrinkling or breaking of the sheet when driven on, yet thin enough to allow rolling or folding of the flexible enclosure for stowage.

The concave surface at a proximal vertically disposed post is configured to receive a portion of the flexible enclosure below the closing means to avoid tensioning of the flexible enclosure by allowing this portion of the flexible enclosure to lay flat when a vehicle enters the volume. This concave surface enables the proximal vertically disposed post to delineate the outermost periphery of the proximal end of the vehicle enclosure such that the flexible enclosure remains taut when supported on the support frame system.

The weigh down plates mark the travel limit of a vehicle being parked in present vehicle enclosure such that external guidance for parking the vehicle is unnecessary. The weigh down plates also take advantage of the vehicle's weight to stabilize the support frame system relative to the vehicle such that the support frame system may not be inadvertently moved to contact the body of the vehicle.

DETAILED DESCRIPTION OF A PREFERRED EMBODIMENT

The term "about" is used herein to mean approximately, roughly, around, or in the region of. When the term "about" is used in conjunction with a numerical range, it modifies that range by extending the boundaries above and below the numerical values set forth. In general, the term "about" is used herein to modify a numerical value above and below the stated value by a variance of 20 percent up or down (higher or lower).

The term "vehicle" as used in this disclosure shall mean an automobile, car, van, boat, watercraft, trailer, motorcycle, All Terrain Vehicle (ATV), truck, Sports Utility Vehicle (SUV) and any mechanized equipment capable of mobility.

Figure 6:
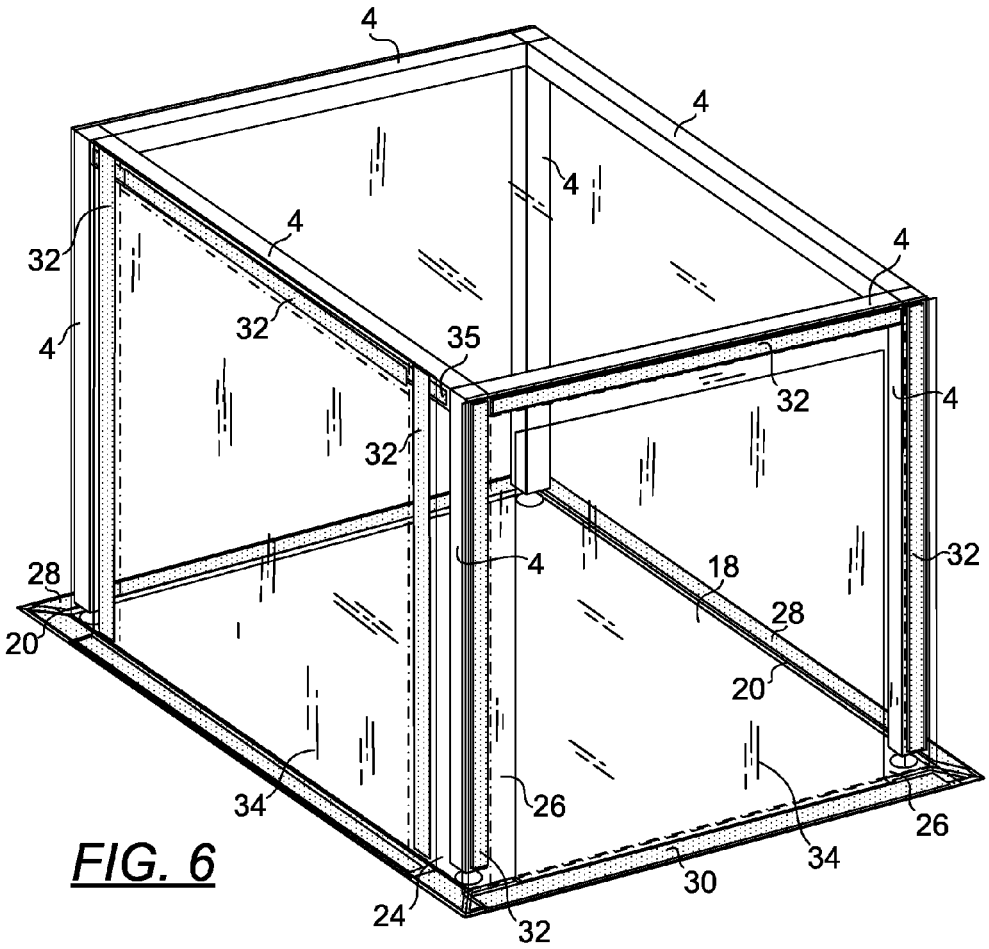
FIG. 6 is a top front perspective view of a completely erected vehicle enclosure according to the present invention.

FIG. 1 is a side orthogonal view of a vehicle 2 stored in a portable passive anti-corrosion vehicle enclosure 6 according to the present invention. The vehicle enclosure 6 is configured to accommodate a vehicle 2 and leave sufficient space around the front, back, top and sides of the vehicle such that no part of the enclosure comes in contact with the vehicle 2 body. The vehicle enclosure 6 is preferably sized to provide space for a driver of the vehicle to exit the vehicle upon parking it in within the vehicle enclosure 6. In use, a floor sheet 18 is first positioned on a substantially flat surface such as a garage floor 12. A support frame system comprising support members 4 is then erected over the floor sheet 18. An enclosing sheet 24 configured in a rectangular shape approximating the shape and size of the support frame system is positioned over the support frame system until its periphery is substantially sealed against the periphery of the floor sheet 18. There is disposed an opening (27 of FIG. 4) on the front 8 of the vehicle enclosure 6 to facilitate entry and exit of the vehicle 2. Preferably, the rear 10 of the vehicle enclosure 6 is sealed to minimize the potential of accidentally leaving an opening unsealed. However, it shall be understood that an opening may alternately be placed in the rear 10 of the vehicle enclosure 6 to enable entry and exit through both the front 8 and the rear 10 of the vehicle enclosure 6. A magnet strip 35 is disposed on a horizontal support member 4 and configured for hanging a door panel 34 (as shown in FIG. 6) upon its removal.

Figure 2:
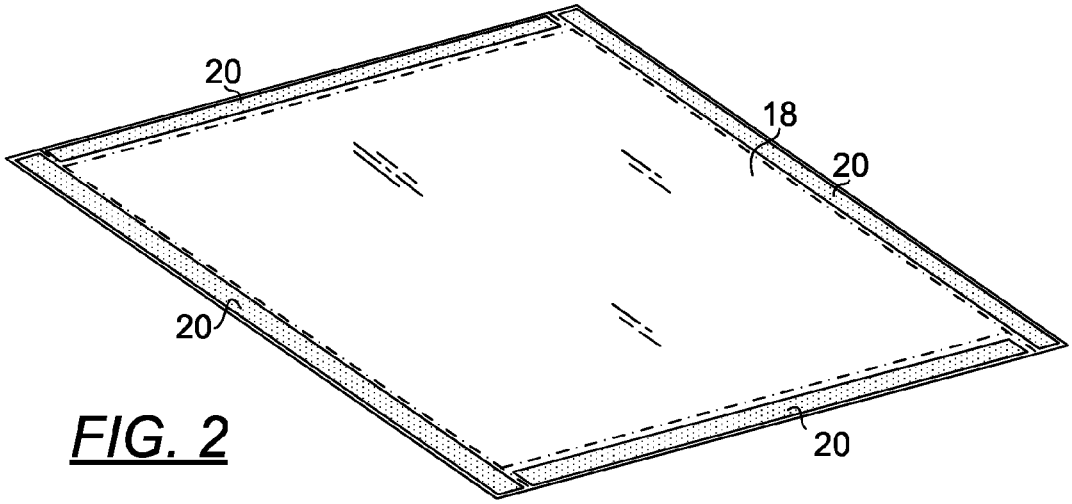
FIG. 2 is a top perspective view of a floor sheet of the present invention.

FIG. 2 is a top perspective view of a floor sheet 18 of the present invention. The floor sheet 18 is preferably constructed from a multilayer sheet having a substantially moisture barrier layer for contacting a floor and a corrosion protection layer disposed integrally but on the top surface of the moisture barrier layer. Preferably, the moisture barrier layer is made of nylon but other moisture impenetrant materials may also be used. The floor sheet 18 preferably measures from about 8 to about 12 mil thick to ease rolling or folding for stowage but yet provides sufficient strength to be walked on or driven on without wrinkling, tearing or breaking. The corrosion protection layer is preferably impregnated with VPCI molecules. In direct contrast to prior art vehicle enclosures having means for corrosion protection, the present invention provides a passive means for protecting metal corrosion, requiring no external or active power. Reference is made to the VPCI impregnated materials disclosed in U.S. Pat. No. 6,439,384 to Martin, the disclosure of which is hereby incorporated by reference. Another example of a VPCI impregnated material is VPCI impregnated film products manufactured by Cortec Corporation and marketed under the tradename "VPCI 126."

There is further disposed a sealing portion along the periphery of the floor sheet 18. The floor sheet 18 has four edges and is substantially rectangularly shaped with a footprint sized to sufficiently encompass an area taken up by a vehicle to be protected. In order to facilitate stowage or transport of the floor sheet 18, the sealing portion is configured to be removable. In a preferred embodiment, the sealing portion comprises magnet strips 20. One or more strips of magnet are disposed along each edge of the floor sheet 18. Multiple strips of magnet are utilized to collectively span an edge exceeding a length convenient for storing the strips of magnet. In order to facilitate transport, the magnet strips 20 are removably disposed on the periphery of the floor sheet 18. An elongated pocket for receiving one or more magnet strips 20 is disposed on each edge of the floor sheet 18. Each strip of magnet preferably comprises a cross-sectional profile of ⅛ inch by 1 inch. Such profile is not conducive to folding or rolling the floor sheet 18 into a small convenient diameter. In order to roll the floor sheet 18, magnet strips 20 are preferably removed in pairs. Magnet strips 20 installed on parallel edges shall be removed as a pair. The floor sheet 18 is then rolled at a right angle to the lengthwise direction of the remaining pair of magnet strips 20. If folding is necessary to collapse the floor sheet 18 into an even smaller footprint, all magnet strips 20 should be removed.

Figure 3:
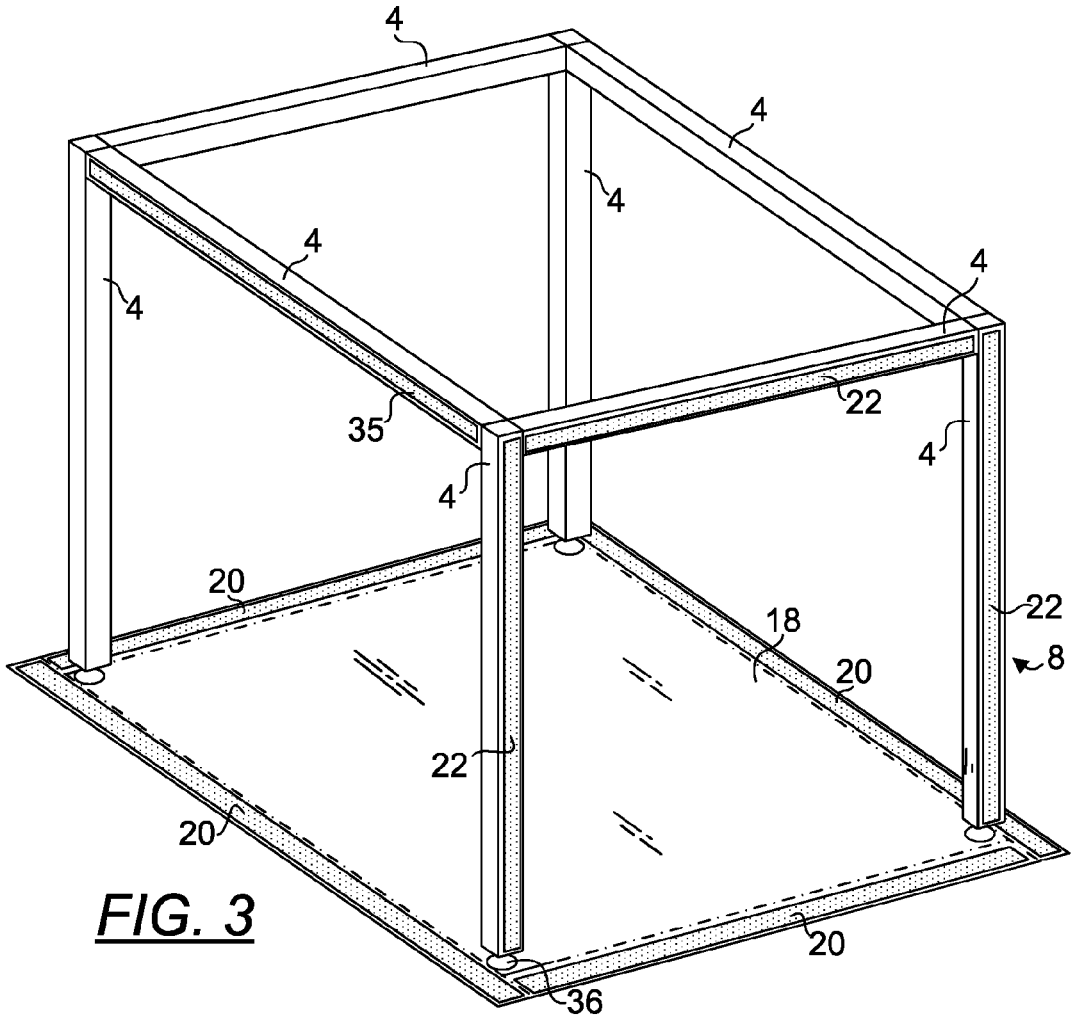
FIG. 3 is a top front perspective view of a support frame system positioned over a floor sheet according to the present invention.

FIG. 3 is a top front perspective view of a support frame system positioned over a floor sheet 18 according to the present invention. The support frame system comprises a plurality of support members 4 configured into a rectangular frame having a rectangular top with four vertical legs. One example of the support frame system is a T-slotted extruded aluminum bars and locking systems manufactured by MiniTec Framing Systems, LLC although other clean, relatively lightweight framing materials that are easy to setup may also be used. The MiniTec framing system comprises support members 4 having slotted and interlocking profiles at the ends of and adjacent the ends of each support member 4 configured to be secured with screws operable with an Allen wrench, thereby eliminating the need for special braces for securing each top corner of the frame system.

There is further disposed a level adjuster 36 at the bottom end of each vertical support member 4 for level correction. This feature is especially useful if the floor on which the enclosure is disposed is not level. Proper leveling of the support frame system causes the enclosing sheet 24 to be supported tautly and minimizes wrinkling of the enclosing sheet 24. One example of a level adjuster 36 comprises a foot portion having a centrally disposed screw configured to be received at the bottom of a vertical support member 4. The support frame system further comprises a door frame constructed by disposing magnet strips 22 on the front face of the front 8 vertical support members 4 of the vehicle enclosure 6. Magnet strips 22 are disposed on two adjacent vertical support members 4 and the horizontal support member 4 spanning the entire width of the opening defined by the two adjacent vertical support members 4. In one preferred embodiment, the magnet strips 22 are riveted to the support members 4. However, the magnet strips 22 may also be glued or otherwise fixedly attached to the support members 4 with minimal gaps between the magnet strips 22 and the support members 4.

Figure 4:
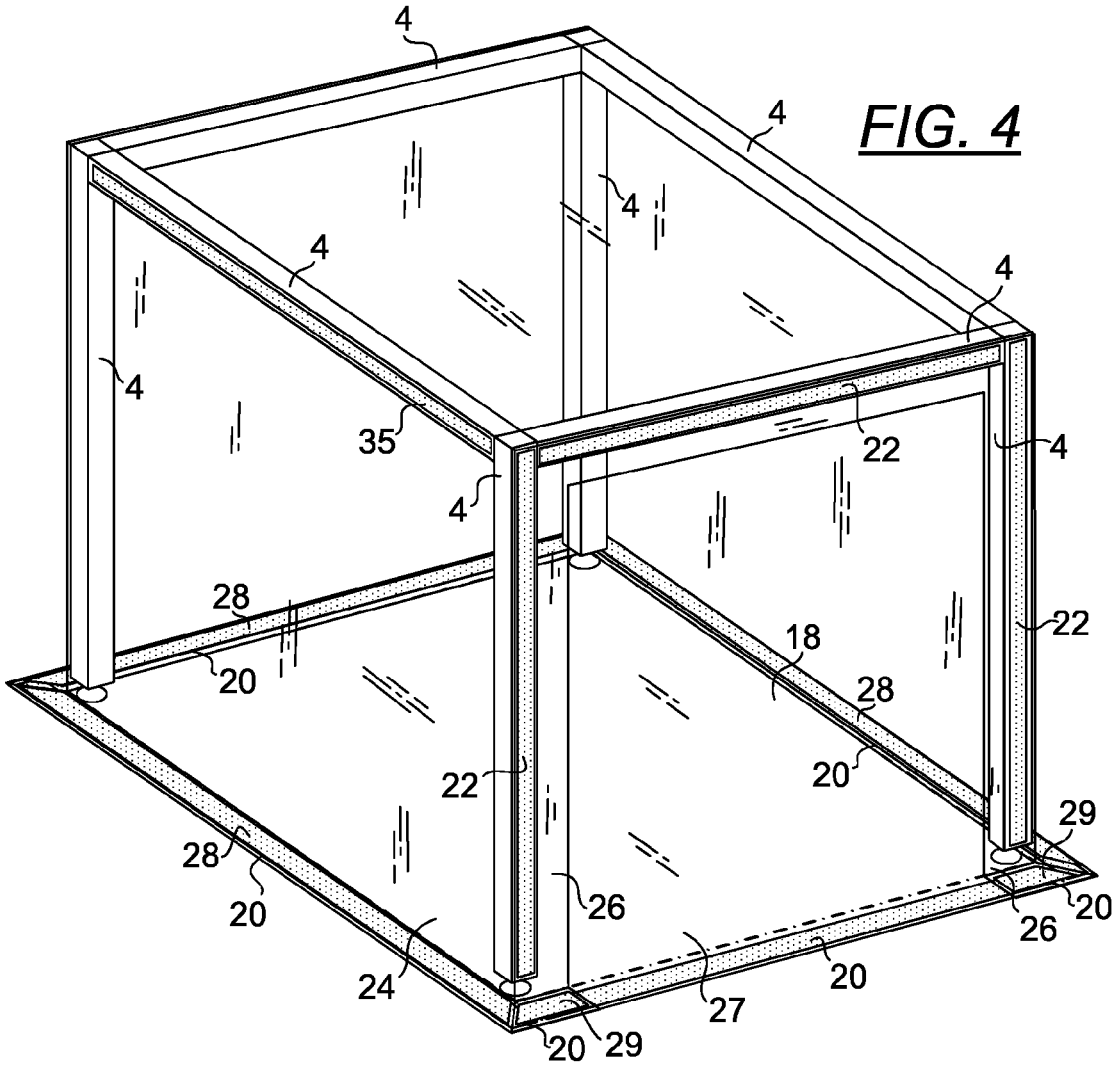
FIG. 4 is a top front perspective view of an enclosing sheet positioned over a support frame system which is in turn positioned over a floor sheet according to the present invention.

FIG. 4 is a top front perspective view of an enclosing sheet 24 positioned over a support frame system which is in turn positioned over a floor sheet 18 according to the present invention. An enclosing sheet 24 configured to enclose three vertical sides and the ceiling of a volume defined by the support frame system is draped over and supported by the support frame system, leaving an opening 27 on the front 8 of the vehicle enclosure 6. The enclosing sheet 24 further comprises a sealing portion along its bottom periphery configured to be matable to the sealing portion along the periphery of the floor sheet 18. The sealing portion along the bottom periphery of the enclosing sheet 24 is constructed from one or more magnet strips 28 capable of magnetic attachment to the sealing portion of the floor sheet 18. In one preferred embodiment as shown in FIG. 4, a doorway fringe 26 is provided around the opening 27 on the front of the vehicle enclosure 6. Although unnecessary, the enclosing sheet 24 is preferably constructed in the shape and size of the support frame system such that when deployed, the enclosing sheet 24 is configured to fit tautly over the support frame system. Before transporting or stowing the enclosing sheet 24, all magnet strips 28, 29 are removed such that the enclosing sheet 24 can be folded and rolled into a small and tight package.

The enclosing sheet 24 preferably measures from about 8 mil to about 12 mil thick to ease rolling or folding for stowage but yet provides sufficient strength to prevent against wrinkling and accidental puncturing forces from breaking the enclosing sheet 24. The outer layer facing away from the vehicle enclosure 6 is preferably constructed from a substantially strong material such as nylon, polypropylene, polyethylene, polyester, laminating film foil, vacuum metalized foil and the like. A corrosion protection layer is preferably impregnated with VPCI molecules on the inside surfaces of the enclosing sheet 24.

Figure 4A:
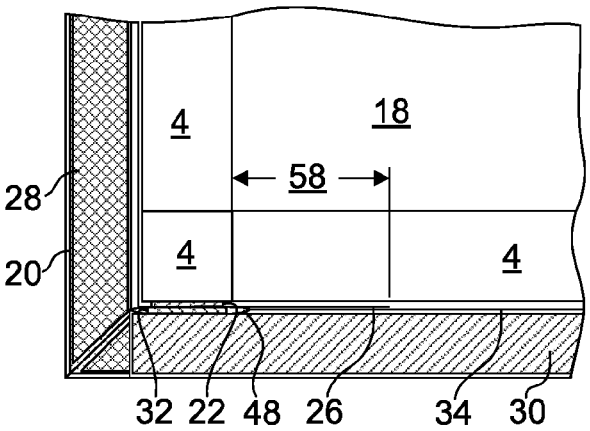
FIG. 4A is a partial top orthogonal view of a front corner of the enclosure depicting the relationships between the doorway fringe, magnet strips and support frame system.

FIG. 4A is a partial top orthogonal view of a front corner of the vehicle enclosure 6 depicting the relationships between the doorway fringe 26, magnet strips 20, 22, 28, 30, 32 and the support frame system. The doorway fringe 26 is preferably extended a distance 58 of from about 1 inch to 5 inches from a support member 4 into the opening 27 of the enclosing sheet 24 to provide sufficient grip to the support frame system in order to prevent accidental detachment of the enclosing sheet 24 from the support frame system. There is further provided a corresponding magnet strip 29 for further securing the enclosing sheet 24 to the floor sheet 18 just below the doorway fringe 26.

Figure 5:
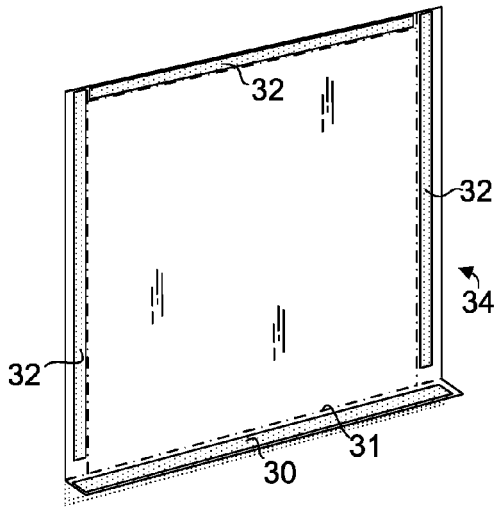
FIG. 5 is a top front perspective view of a door panel according to the present invention.

FIG. 5 is a top front perspective view of a door panel 34 according to the present invention. The door panel 34 is substantially similar to the floor sheet 18 except the door panel 34 is preferably semi transparent to properly reveal the contents of the vehicle enclosure 6 from all sides. The door panel 34 is also configured with an increased size magnet strip 30 to ensure that the threshold of the opening 27 is properly sealed when the door panel 34 is placed over the opening 27. The door threshold magnet strip 30 is shown disposed at substantially right angle to the door panel 34 or in a bent position along a bend 31. The bend 31 typically occurs along an edge of the pocket in which the door threshold magnet strip 30 is disposed and it is substantially close to the floor when mounted over the opening 27 of the vehicle enclosure 6.

The door panel 34 is sized to match the opening 27 where the magnet strips 32 are configured to overlap the magnet strips 22 disposed on vertical support members 4 and horizontal support member 4 of the door frame and the door threshold magnet strip 30 overlaps the magnet strips 20, 29 on the bottom edge of the opening 27. The door panel 34 preferably measures from about 8 mil to about 12 mil thick to ease rolling or folding for stowage but yet provides sufficient strength to prevent against wrinkling and accidental puncturing forces from breaking the door panel 34. The outer layer facing away from the vehicle enclosure 6 is preferably constructed from a substantially strong material such as nylon, polypropylene, polyethylene, polyester, laminating film foil, vacuum metalized foil and the like. A corrosion protection layer is preferably impregnated with VPCI molecules on the inside surfaces of the enclosing sheet 24. The floor sheet, enclosing sheet and door panel configured for a midsized sedan preferably weigh less than about 15 lbs in total excluding the magnet strips and the support frame system preferably has a weight per linear foot of less than about 0.7 lb/ft. The magnet strips preferably weighs less than 4 lbs in total. The lightweightness of the materials used to construct the present invention presents significant advantage over the two-piece cover design disclosed in US Pat. App. Pub. No. 2006/0043760 where weight will be an issue for a large cover.

FIG. 6 is a top front perspective view of a completely erected vehicle enclosure 6 according to the present invention. Referring now to both FIGS. 4 and 6, the door panel magnet strips 32 are shown disposed over the door frame magnet strips 22 (as shown in FIG. 4) and the door threshold magnet strip 30 is disposed over a portion of each doorway fringe magnet strip 29 on each end of the door threshold magnet strip 30 and a central portion of one floor sheet magnet strip 20. Each doorway fringe magnet strip 29 is in turn disposed over a portion of a floor sheet magnet strip 20. The tight seals that result from sealing the enclosing sheet 24 against the floor sheet 18 and the door panel 34 against the enclosing sheet 24 and floor sheet 18 ensure that no rodents or larger insects can enter the vehicle enclosure 6. A second door panel 34 is shown in FIG. 6 for illustrating a way a door panel 34 can be protected from getting dirtied when not installed. Upon removal from opening 27, a door panel 34 is disposed over a portion of magnet strip 35 such that the door panel 34 is hung taut with portions of magnet strips 32 overlapping a portion of magnet strip 35. Soiling of the door panel 34 is thus prevented.

Corrosion protection may alternatively be provided in individually packed VPCI materials disposed within the volume defined by the vehicle enclosure 6 in lieu of or in addition to the impregnated VPCI layer on the interior surfaces of each sheet 18, 24 and door panel 34. In order to enhance corrosion protection in addition to the VPCI layer of each sheet 18, 24 and door panel 34, a packet is preferably placed in each wheel well area as well as under the engine and the rear of the vehicle 2. The packets provide additional VPCI molecules released into the volume of the vehicle enclosure 6 to bond with metal surfaces to prevent moisture from bonding with metal surfaces to cause corrosion. Spent packets are discarded and replaced with new packets of VPCI materials.

In contrast to the vehicle enclosure disclosed in U.S. Pat. No. 6,220,263 to Randmae, the present invention requires no power input while in use to keep the enclosure 6 erected. Corrosion protection is also achieved without power input by preventing moisture contact with metal parts compared to Randmae's method of removing moisture using a powered fan. In contrast to the vehicle enclosure disclosed in US Pat. App. Pub. No. 20060043760, the present invention is easy to use without having to rotate a large cover member to enable human and vehicle entry and exit.

Figure 7:
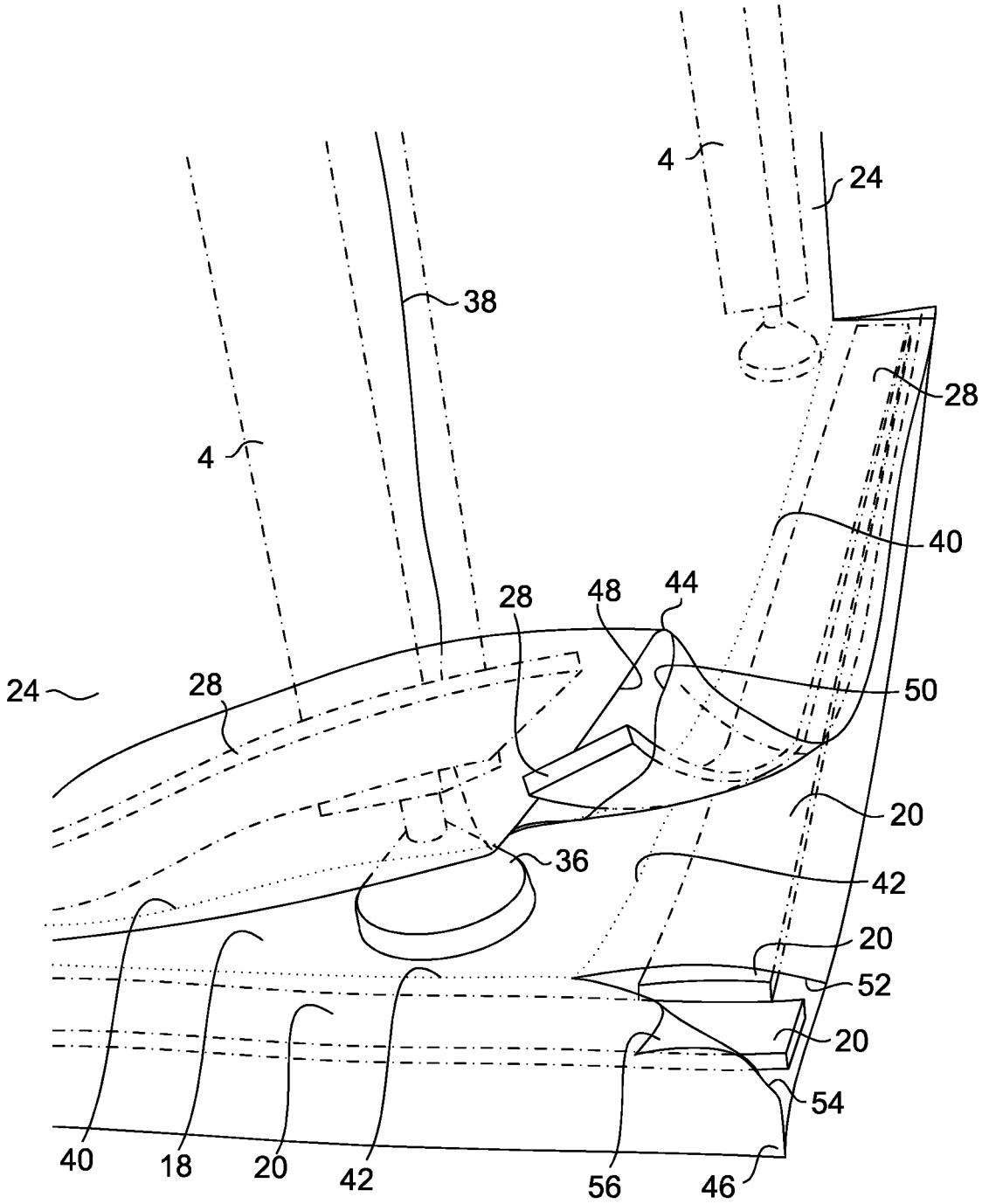
FIG. 7 is a partial top rear perspective view of a bottom rear corner of the present invention depicting a sealing portion of the enclosing sheet being peeled back and magnet strips extended in order to reveal the attaching mechanism of the enclosing sheet to the floor sheet.

FIG. 7 is a partial top rear perspective view of a bottom rear corner of the present invention depicting a sealing portion of the enclosing sheet being peeled back and magnet strips 20, 28 extended in order to reveal the attaching mechanism of the enclosing sheet 24 to the floor sheet 18. A pocket 48 is disposed on each edge of the floor sheet 18 and each bottom edge of the enclosing sheet 24. In its installed position, two adjacent faces of the enclosing sheet 24 are disposed at substantially right angle to each other to form a corner 38. During installation, the periphery of enclosing sheet 24 is bent at bend 40 such that the magnet strip 28 can be installed flat atop the magnet strip 20 to provide maximum attachment between the magnet strips 20, 28. In their installed positions, openings of pockets 48, 50 substantially butt against each other and so do openings of pockets 52, 54. A corner 44 of enclosing sheet 24 is configured to overlap a corresponding corner 46 of the floor sheet 18 in its installed position. Openings of pockets 48 and 50 are configured at about 135 degrees from bend 40 of each vertical face of the enclosing sheet 24. Openings of pockets 52 and 54 are configured at about 0 and 90 degrees from seams 42. The ends of magnet strips 20, 28 are configured at substantially the angles of the openings. Preferably two adjacent sheets are configured to have magnet strip ends at different angles so as to increase the sealing effect of adjacent sheets 24, 18.

Figure 8:
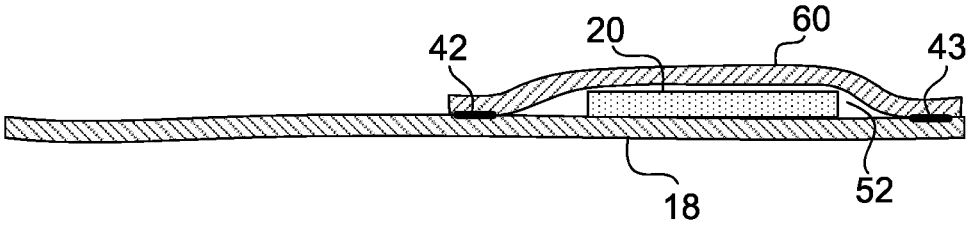
FIG. 8 is a partial cutaway orthogonal view of a pocket depicting a method by which it is formed.
Figure 9:
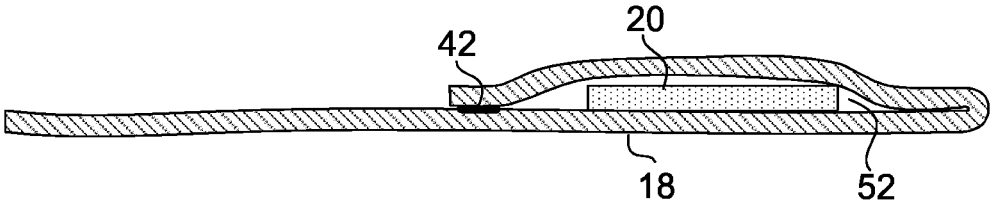
FIG. 9 is a partial cutaway orthogonal view of a pocket depicting a method by which it is formed.
Figure 10:
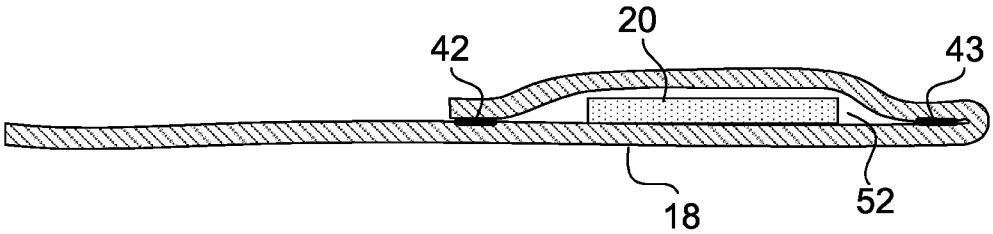
FIG. 10 is a partial cutaway orthogonal view of a pocket depicting a method by which it is formed.

FIGS. 8, 9 and 10 are partial cutaway orthogonal views of a pocket depicting methods by which it is formed. All magnet strip pockets of the present invention may be formed from one of the following methods. Although these methods are applicable to the floor sheet 18, enclosing sheet 24 and door panel 34, only the floor sheet 18 is shown in FIGS. 8, 9 and 10. Referring to FIG. 8, a strip 60 having similar mechanical properties to the floor sheet 18 is positioned over an edge of the floor sheet 18 and fixedly attached at its edges to the floor sheet 18 at seams 42, 43 to form a pocket 52. The seams are heat melted and then pressed together to form tight bonds. Referring to FIG. 9, an edge is folded back and heat sealed at seam 42 to form a pocket 52. In one embodiment, an additional step is taken to the embodiment shown in FIG. 8 to heat seal the edge of the floor sheet 18 at seam 43 as depicted in FIG. 9 to further strengthen the edge of the floor sheet 18.

Figure 11:
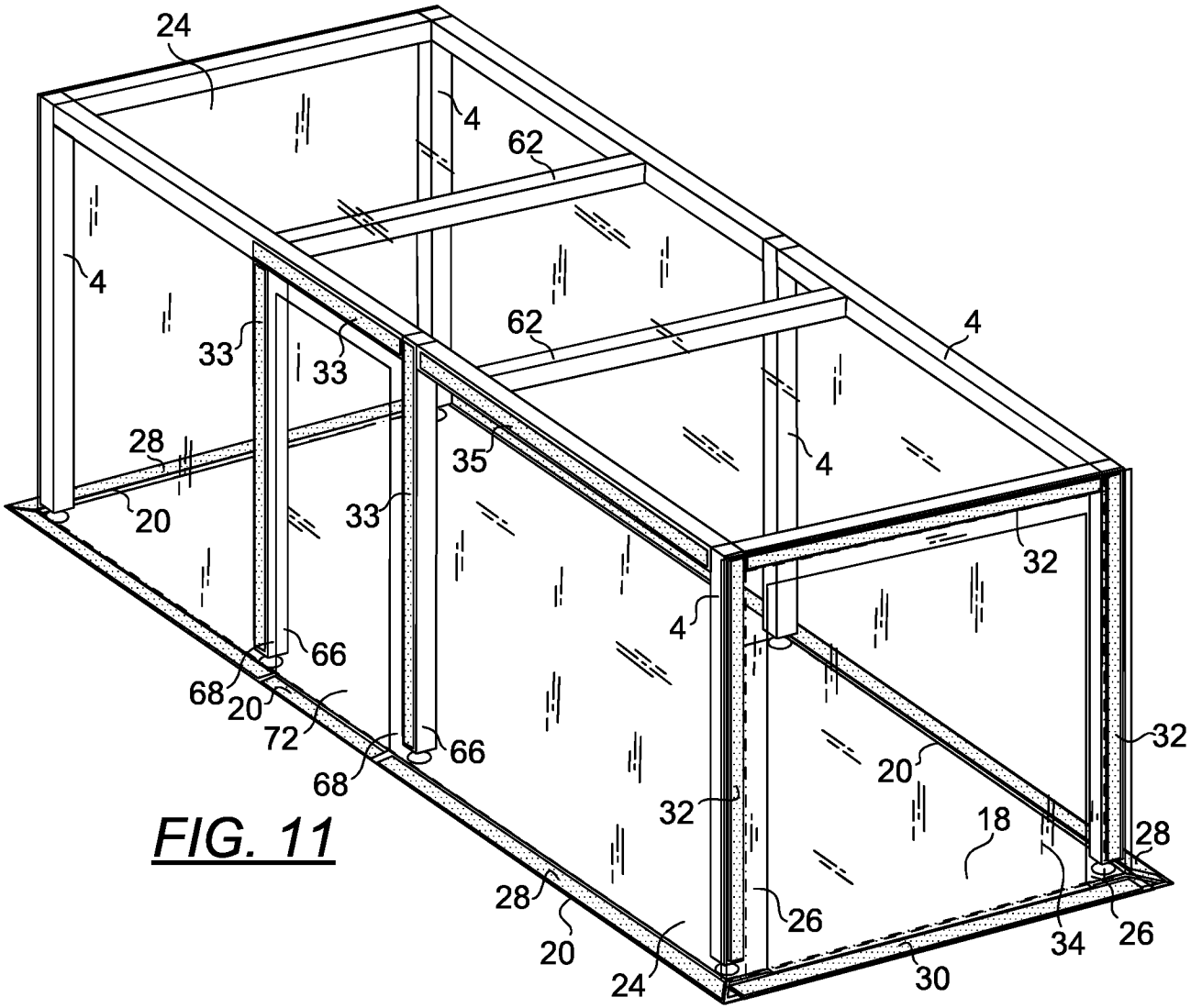
FIG. 11 is a top front perspective view of a completely erected vehicle enclosure according to one embodiment of the present invention depicting a side opening configured to be closed with a side door panel and an additional magnet strip configured for hanging a door panel or side door panel.

FIG. 11 is a top front perspective view of a completely erected vehicle enclosure according to one embodiment of the present invention depicting a side opening 72 configured to be closed with a side door panel. An additional magnet strip 35 is disposed on a horizontal support member 4 and configured for hanging a door panel 34 or a side door panel. Additional support members may be required to increase the size of a vehicle enclosure 6. As shown, cross support members 62 are added to brace an elongated support frame system. An additional vertical support member 4 is added to one side of the support frame system while two vertical support members are added to the opposing side to form a side door frame 66. A magnet strip 33 is disposed on each of the support members forming the side door frame 66. Preferably a side doorway fringe 68 is further disposed around the side opening 72. The side doorway fringe 68 is preferably extended a distance of from about 1 inch to 5 inches from a support member 4 or a portion of a support member 4 into the side opening 72 of the enclosing sheet 24 to provide sufficient grip to the support frame system in order to provide increased rigidity around of the enclosing sheet 24 around the side door frame.

Figure 12:
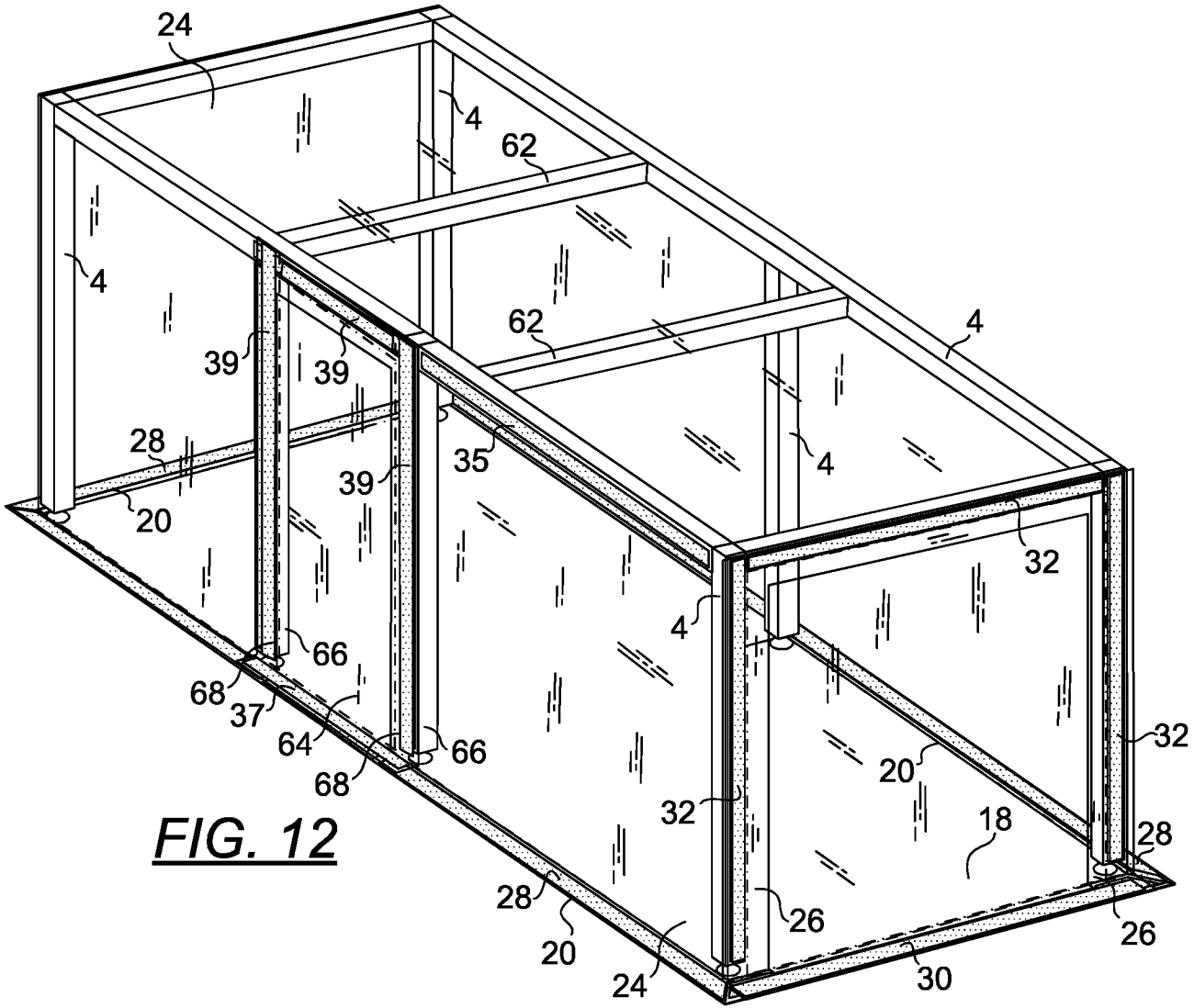
FIG. 12 is a top front perspective view of the completely erected vehicle enclosure of FIG. 11 depicting a closed side opening.

FIG. 12 is a top front perspective view of the completely erected vehicle enclosure of FIG. 11 depicting a closed side opening 72. Similar to the door panel 34, the side door panel 64 also comprises magnet strips 39, 37 on its periphery. The side door panel 64 is sized to match the side opening 72 such that the magnet strips 39 are configured to overlap the magnet strips 33 disposed on side door frame 66 and that the side door threshold magnet strip 37 overlaps a portion of magnet strips 20, 28 on the bottom edge of the side opening 72. The side door panel is preferably impregnated with VPCI molecules on the surface facing the volume in its installed configuration.

Figure 13:
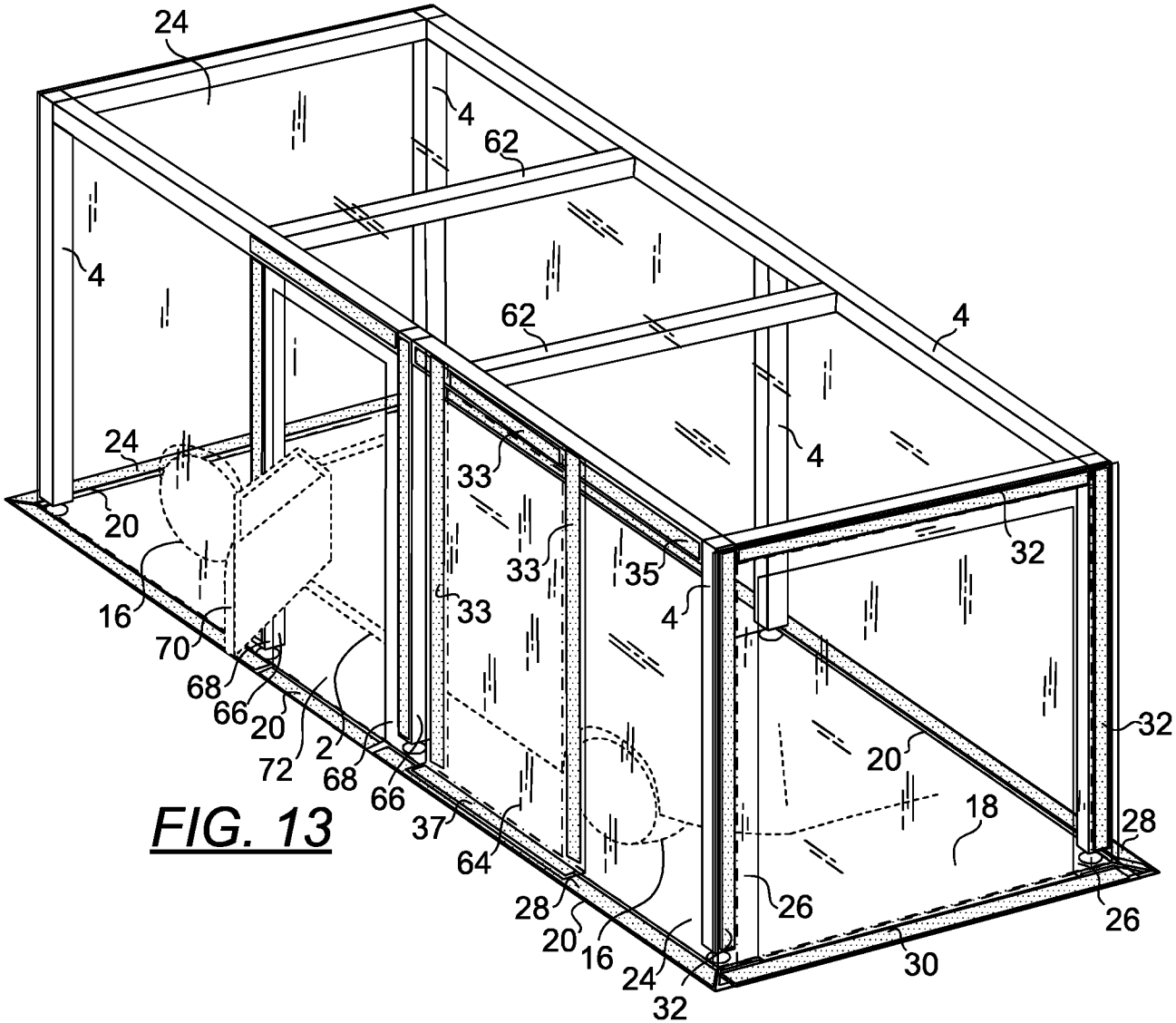
FIG. 13 is a top front perspective view of the completely erected vehicle enclosure of FIG. 12 depicting an opened side opening for use as exit for a driver upon parking a car in the enclosure.
Figure 14:
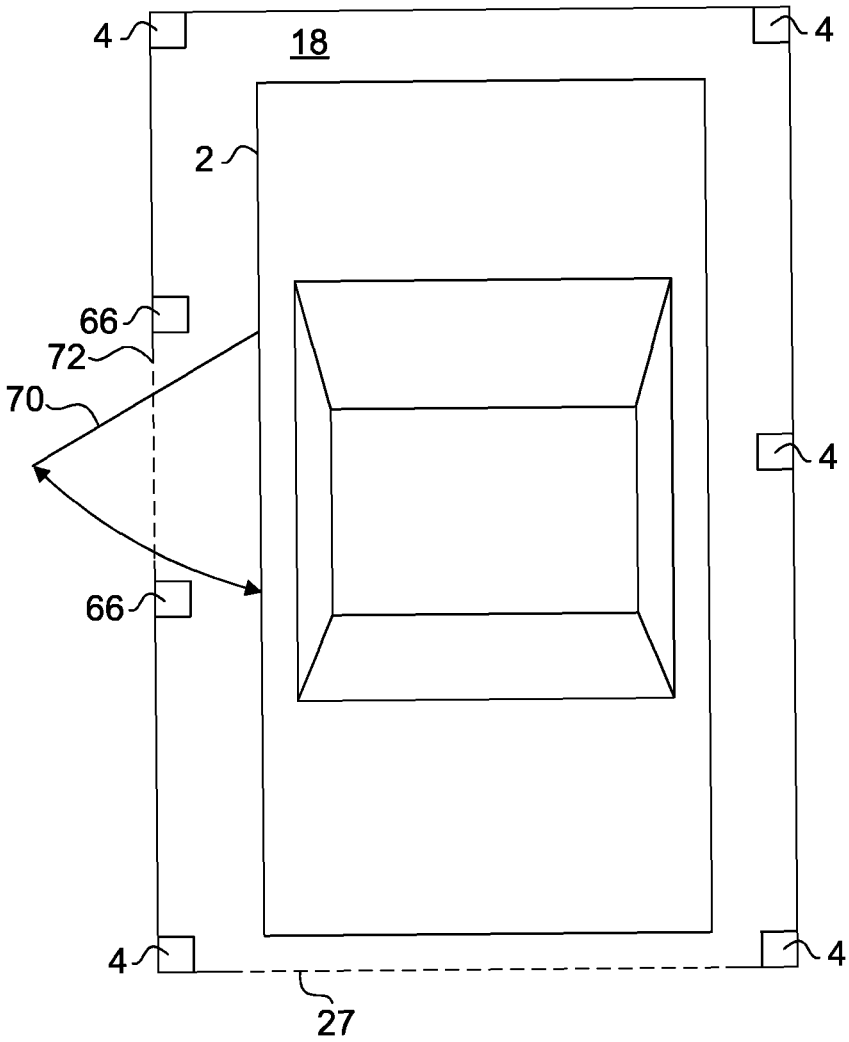
FIG. 14 is a simplified top view of FIG. 13 depicting the parked car in relation to the enclosure.

FIG. 13 is a top front perspective view of the completely erected vehicle enclosure of FIG. 12 depicting an opened side opening 72 for use as an exit for a driver upon parking a car in the enclosure 6. A portion of a vehicle 2 is shown in broken lines to show the benefit of having a side opening 72. Upon parking a vehicle 2 in the vehicle enclosure 6, a driver proceeds to open the driver side door and exit the vehicle 2. The side opening 72 enables the driver to swing the car door open through the side opening 72. FIG. 14 is a simplified top view of FIG. 13 depicting the parked vehicle 2 in relation to the vehicle enclosure 6. It shall be noted that by having a side opening 72, the vehicle enclosure 6 can be sized smaller and any contact of the body of the vehicle 2 with the vehicle enclosure 6 can still be avoided. Having smaller enclosures saves space and requires less material for fabrication.

In order to avoid soiling a removed door panel 34 or side panel door 64, a hanger is provided. Referring again to FIG. 13, the removed side door panel 64 is disposed over a portion of magnet strip 35 such that the side door panel 64 is hung taut with a portion of magnet strips 33 overlapping a portion of magnet strip 35. Although not shown in FIG. 13, a removed door panel 34 can also be hung directly over a portion of magnet strip 35 or over a portion of magnet strip 33 of the side door panel 64 which in turn overlaps a portion of magnet strip 35. Alternatively, a removed side door panel 64 can be hung directly over a portion of magnet strip 35 or over a portion of magnet strip 32 of the door panel 34 which in turn overlaps a portion of magnet strip 35.

Figure 15:
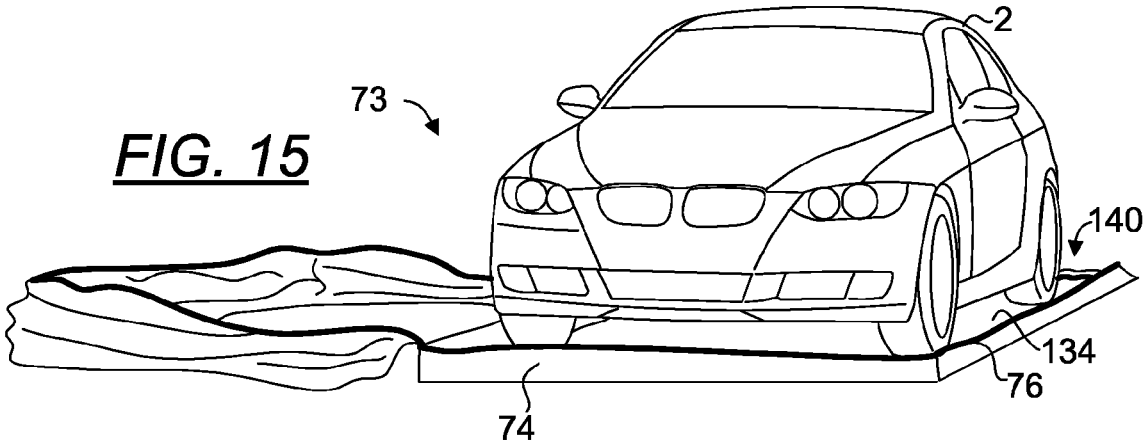
FIG. 15 is a top rear perspective view of another embodiment of the present enclosure depicting the enclosure in its open position.
Figure 16:
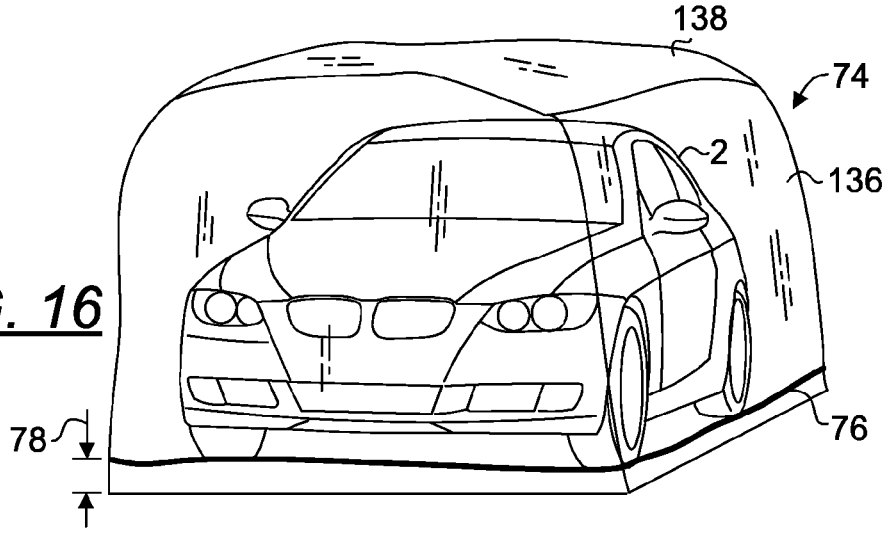
FIG. 16 is a top rear partially transparent perspective view of another embodiment of the present enclosure depicting the enclosure in its closed position.
Figure 17:
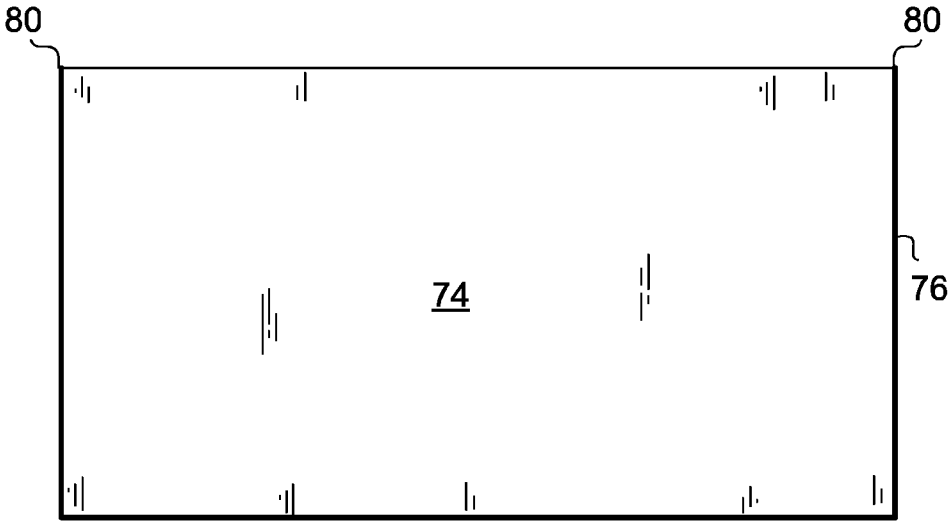
FIG. 17 is a plan view of the embodiment depicted in FIG. 16.

FIG. 15 is a top rear perspective view of another embodiment of the present enclosure depicting a vehicle enclosure 73 in its open position. FIG. 16 is a top rear perspective partially transparent view of another embodiment of the present enclosure depicting a vehicle enclosure 73 in its closed position and that the vehicle enclosure 73 is sized to envelope a vehicle 2. The vehicle enclosure is preferably rectangular as it is most conveniently fabricated in the shape and size of the vehicle it is configured to store. However, a dome shaped enclosure with a round floor sheet may also be possible. The vehicle enclosure 73 comprises a flexible enclosure 74 defining a volume sufficient for storing a vehicle 2 in its entirety. The flexible enclosure comprises a floor sheet 134 having a periphery, a closed ended side sheet 136 having a top periphery and a bottom periphery, a ceiling sheet 138 having a periphery and a closing means 76. The side sheet 136 is fixedly attached at the bottom periphery to the floor sheet periphery. The side sheet 136 is also fixedly attached at the top periphery to the ceiling sheet periphery and the closing means 76 is disposed on a portion of the side sheet 136 at an offset 78 from the floor sheet 134 and substantially parallelly from the periphery of the floor sheet 134. The closing means 76 is configured for providing access of the volume for storing the vehicle 2 and isolating the volume from its surrounding environment. In one embodiment, the closing means 76 is disposed at an offset 78 of about 6 inches from the floor on which the vehicle enclosure 73 is disposed. The vehicle enclosure 73 is shown in its erected condition for clarity. However, without any external aid, the side sheet 136 and the ceiling sheet 138 will tend to fall onto or come into contact with the body of the vehicle 2. FIG. 17 is a plan view of the embodiment depicted in FIG. 16 showing the extent of the closing means 76 which spans three sides of the side sheet 136 and terminates at points 80.

In one embodiment, the closing means is a waterproof zipper according to MaxiGrip MX392T and provided by ITW MaxiGrip, 95 Commerce Drive, Somerset, N.J. 08873. Although less desirable, conventional zippers having polymeric or metallic interlocking elements may also be utilized. In implementing a zipper, a cut is first made at appropriate height of the side sheet 136 and then the zipper may be adhesive or heat bonded to the side sheet 136. Applicant discovered that, by disposing the closing means or zipper 76 at an offset from the floor, access of ants, rodents and other pests can be further avoided, even if the closing means is not properly closed or accidentally left open. Preferably, the moisture barrier layer is made of a plastic composite of several layers but other moisture impenetrant materials may also be used. A suitable stack of plastic composite layers includes 48 gauge Polyethylene Terephthalate (PET), 30 gauge reflective foil, 1.25 mil PE, 5×5 scrim and 1.25 mil Polyethylene (PE). These composite layers ease rolling or folding for stowage but yet provide sufficient strength to be walked on or driven on without wrinkling, tearing or breaking. In this embodiment, the sheets 134, 136, 138 are also VPCI impregnated. In one aspect, the sheets 134, 136, 138 are fabricated as a single sheet. In another embodiment, the sheets 134, 136, 138 are fabricated are fabricated as discrete sheets joined at their peripheries.

In one embodiment, the applied VPCI layer is about 4 mil thick. The isolation of the volume defined by and afforded by the enclosure is important to prevent escape of VPCI molecules to the environment outside of the vehicle enclosure 73 once the zipper 76 has been properly closed. In order to enhance corrosion protection in addition to the VPCI layer of each sheet 134, 136, 138, a packet is preferably placed in each wheel well area as well as under the engine and the rear of the vehicle 2. In use, the floor sheet 134 is simply laid flat on a floor and the zipper unzipped such that the portion of the flexible enclosure above the zipper 76 can be folded back and disposed adjacent the floor sheet 134 as depicted in FIG. 15. A vehicle 2 to be stored in the vehicle enclosure 73 is cleaned and dried before being driven onto the floor sheet 134. The portion of the flexible enclosure 74 that was folded back is then brought over the vehicle 2 such that the mating portions of zipper 76 are brought together to be "zipped." In some cases, a secondary vehicle enclosure may be draped over the vehicle prior to closing the enclosure. Even if a secondary vehicle enclosure is used, vehicle parts most vulnerable to corrosion are still exposed to application of VPCI molecules and therefore not significantly affecting the effectiveness of the present corrosion protection afforded by such molecules. In cases where no contact is desired between the vehicle enclosure 73 and the vehicle 2, a support frame system 81 is further provided and disposed within the vehicle enclosure 73 as shown in the following figures.

Figure 18:
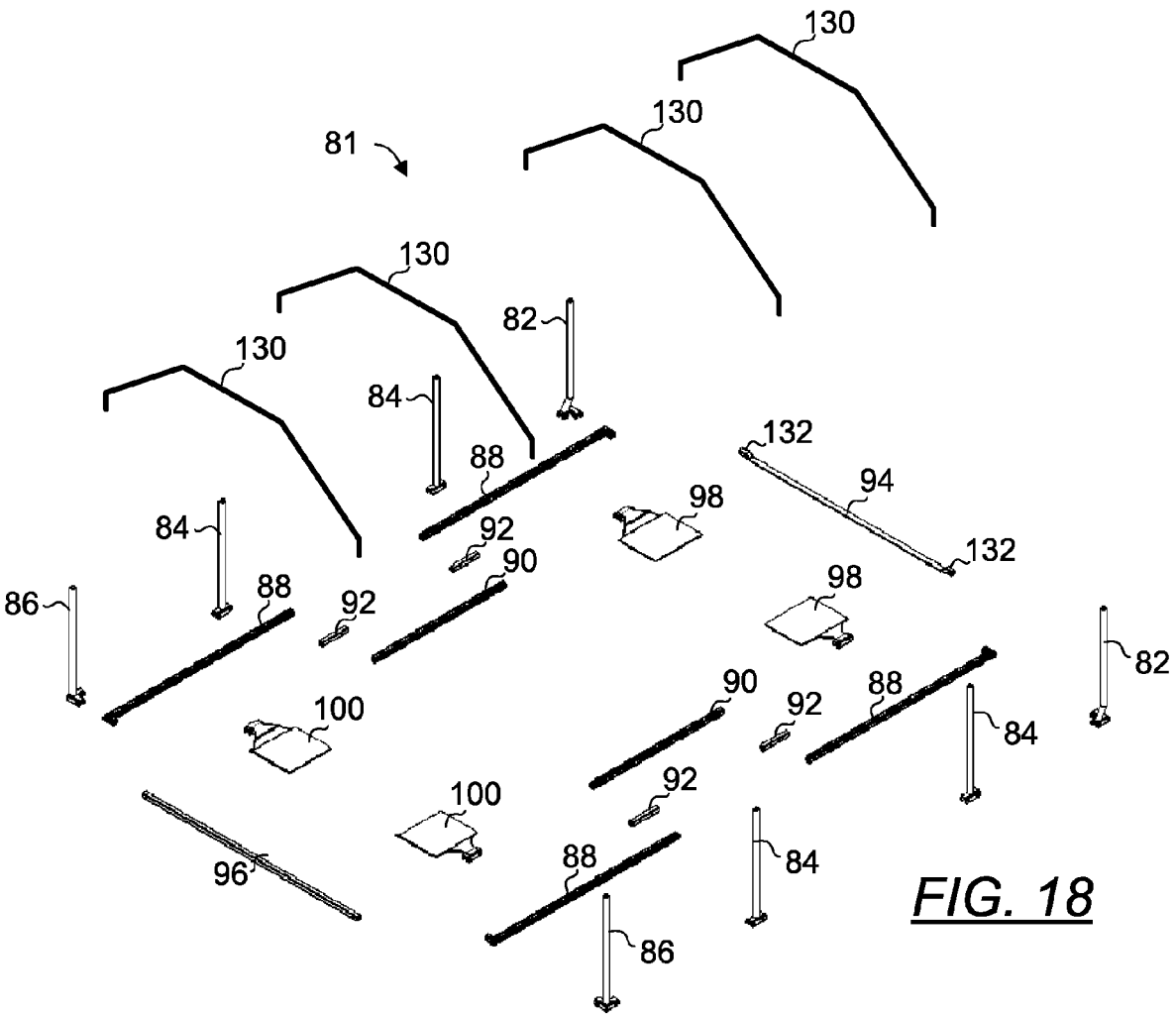
FIG. 18 is a top rear exploded perspective view of a support frame system used in conjunction with the embodiment of FIG. 16.
Figure 19:
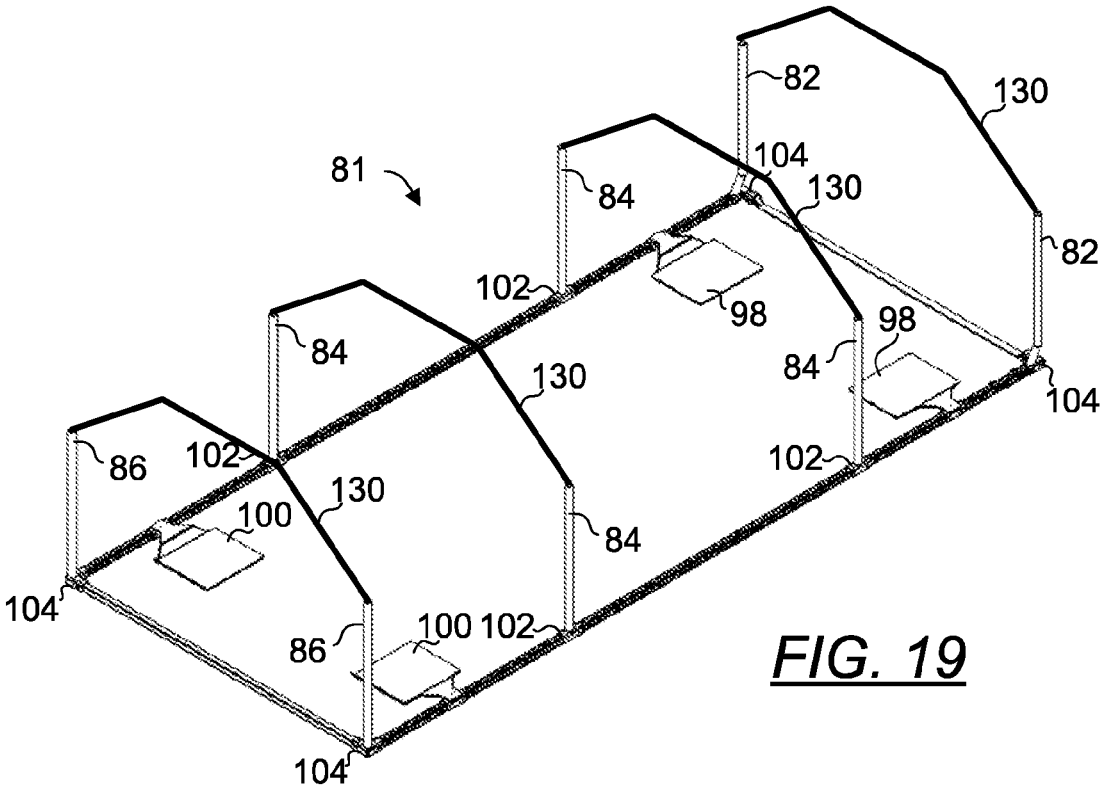
FIG. 19 is a top rear perspective view of the embodiment of FIG. 18.
Figure 20:
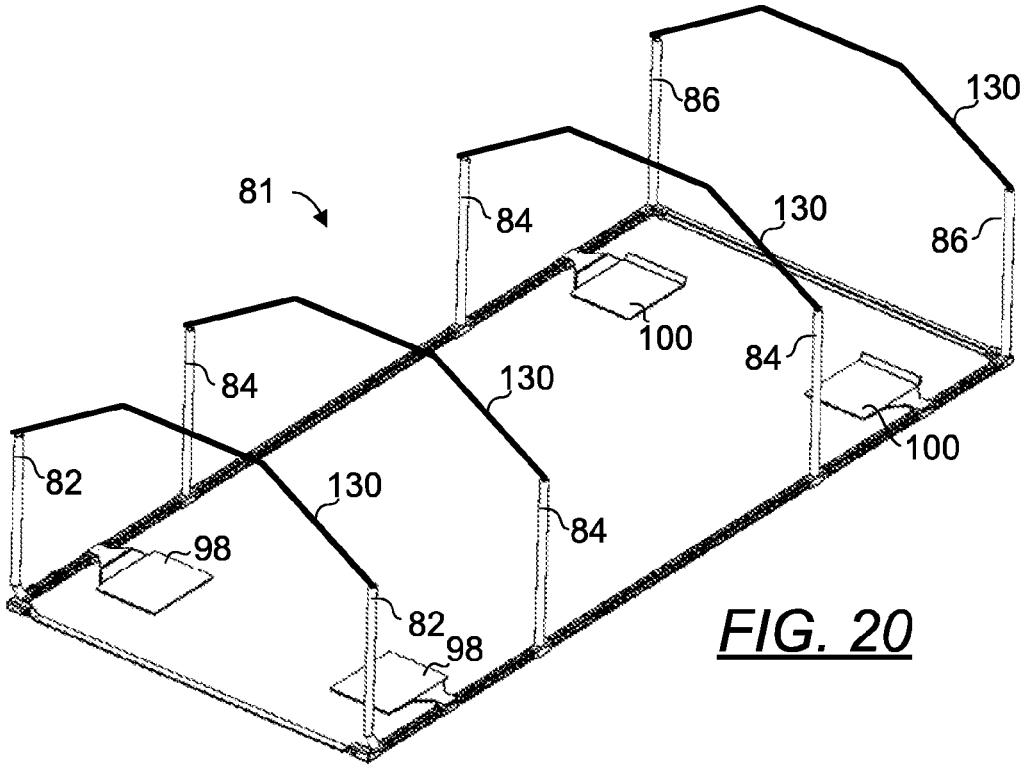
FIG. 20 is a top front perspective view of the embodiment of FIG. 19.

FIG. 18 is a top rear exploded perspective view of a support frame system used in conjunction with the embodiment of FIG. 16. FIG. 19 is a top rear perspective view of the embodiment of FIG. 18. FIG. 20 is a top front perspective view of the embodiment of FIG. 19. The support frame system 81 defines a volume in which a vehicle is to be stored. The support frame system 81 comprises a bottom frame capable of being sized to accommodate the vehicle to be stored, a plurality of vertically disposed posts 82, 84, 86 and a plurality of support bars 130. The bottom frame is constructed from four side and corner frames 88, a pair of side extension frames 90, a proximal cross bar 94, a distal cross bar 96, two pair of extension blocks 92 and a plurality of "G" shaped (hereinafter G) pins. Each side and corner frame 88 is essentially an L-shaped bar having a substantially hollow rectangular cross-sectional profile. Each side extension frame 90 is essentially a rectilinear bar having a similar cross-sectional profile as the side and corner frame 88. In order to assemble a bottom frame, all side and corner frames 88 are arranged symmetrically to form the corners of the bottom frame. A distal cross bar 96 is disposed at the distal end of the support frame system 81 and connected at each of its ends to a side and corner frame 88. A proximal cross bar 94 is disposed at the proximal end of the support frame system 81 and connected at each of its end connectors 132 to a side and corner frame 88. The proximal cross bar 94 is preferably a flat bar to allow easy entry and exit of a vehicle from the volume defined by the support frame system. The pair of side extension frames 90 is provided to allow adjustment capability to the bottom frame and to extend the lengthwise dimension of the bottom frame. In order to connect a side extension frame 90 to a side and corner frame 88, an extension block 92 is inserted within the ends of these two parts. In the embodiment shown, each top support bar 130 is an arch having two ends and constructed from polyvinyl chloride (PVC) although other lightweight and structurally sound materials may also be used. Each top support bar 130 is attached to a pair of transversely disposed posts by inserting its ends into the top ends of a pair of transversely spaced vertically disposed posts.

Figure 21:
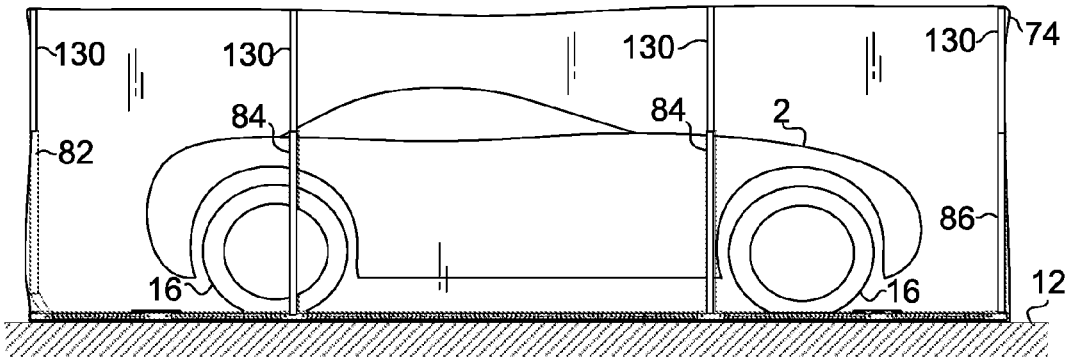
FIG. 21 is a partially transparent side orthogonal view of a vehicle being stored in one embodiment of the present invention.

FIG. 21 is a partially transparent side orthogonal view of a vehicle being stored in one embodiment of the present invention. The support frame system is disposed within the flexible enclosure and configured for supporting the flexible enclosure 74 such that no part of the vehicle enclosure comes in contacting engagement with the body of the vehicle, thereby not compromising the finish of the body of the vehicle.

Figure 22:
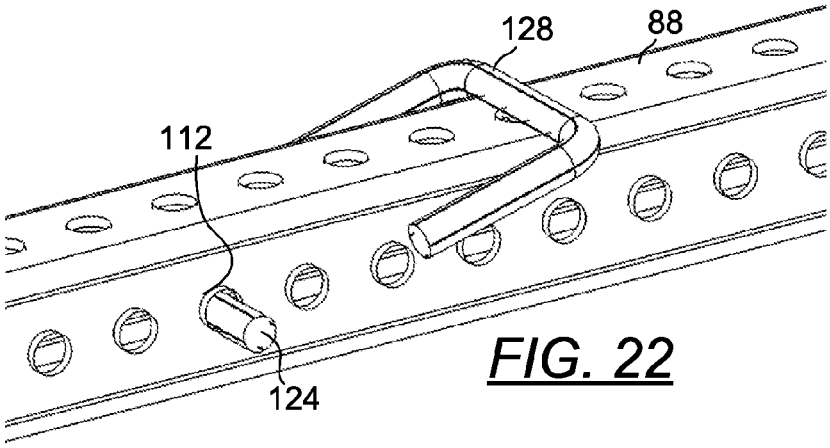
FIG. 22 is a partial top perspective view of a G pin utilized in securing two bottom frame parts.
Figure 23:
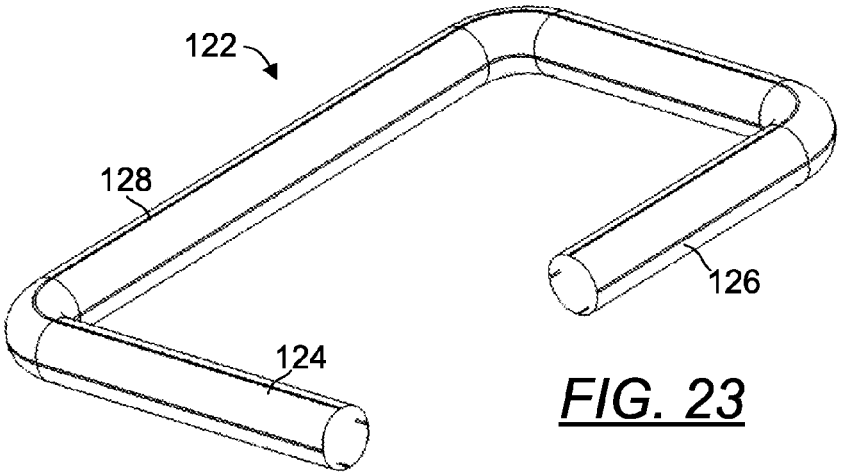
FIG. 23 is a top perspective view of a G pin.

FIG. 22 is a partial top perspective view of a G pin 122 utilized in securing two bottom frame parts. FIG. 23 is a top perspective view of a G pin. Preferably apertures 112 are disposed along at least a portion of each side and corner frame 88, end connector 132, side extension frame 90, extension block 92, side channel 102 and corner channel 104 or portions where these parts are mated. In all instances where two parts are to be connected herein, an aperture of one part is aligned with an aperture of the part to be joined. A G pin is essentially a pin configured in the shape of the letter "G" having a pin portion 124 configured for insertion into apertures 112 disposed on two parts to prevent relative motion between the two parts. Pin portion 124 is connected to a locking portion 126 of G pin by pin portion 128. Upon insertion of pin portion 124, the G pin is released to settle on its own weight such that pin portion 126 and pin portion 128 straddle the outer part of the outer-inner parts (e.g., extension frame-extension block, side channel-side and corner frame, etc.) connection to prevent inadvertent dislodgement of pin portion 124 from the apertures 112.

Figure 24:
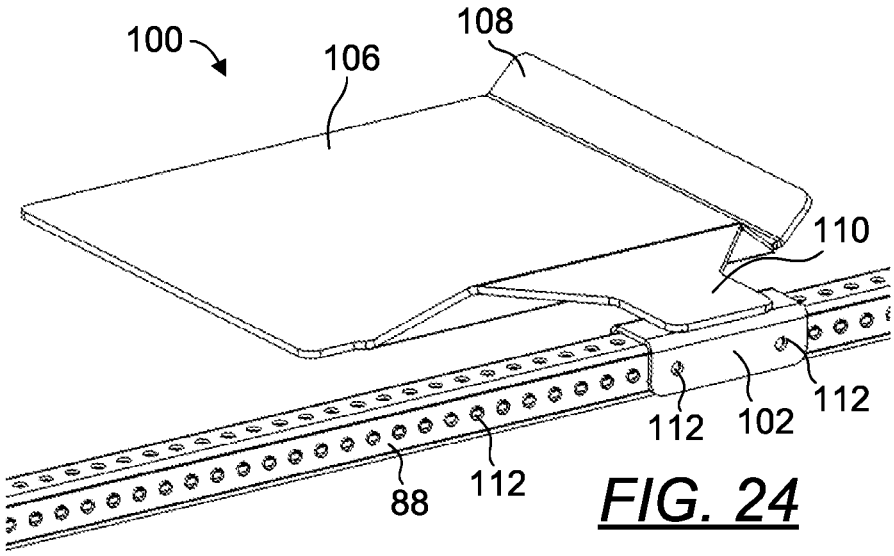
FIG. 24 is a partial top perspective view of a distal weigh down plate of the embodiment of FIG. 19.

There is provided four weigh down plates, i.e., two disposed on the proximal portion of the vehicle enclosure 73 and the remaining two on the distal portion of the vehicle enclosure 73. FIG. 24 is a partial top perspective view of a distal weigh down plate of the embodiment of FIG. 18. Each weigh down plate is capable of position adjustment along the bottom frame and is secured to the bottom frame. In use, before disposing a vehicle in the vehicle enclosure, measurements including the wheelbase, front and rear overhangs of the vehicle and the width of the vehicle are obtained. Such measurements are then used to adjust the size and shape of the bottom frame and relative positioning of the weigh down plates. Each weigh down plate is connected to the bottom frame and configured to be disposed under a wheel of the vehicle 2. When disposed atop the weigh down plates, the weight of the vehicle as transferred through the wheels, aids in securing the support frame system 81 such that relative movements between the support frame system 81 and the vehicle 2 is prevented. Each distal weigh down plate 100 includes a flat portion 106 and a lip portion 108 disposed at one edge of the distal weigh down plate 100. The distal weigh down plate 100 further includes a connecting plate 110 which attaches the flat portion 106 to a side channel 102 configured for lengthwise adjustment along a side and corner frame 88. The lip 108 is configured to mark a travel limit for the vehicle positioned inside the vehicle enclosure 81.

Figure 25:
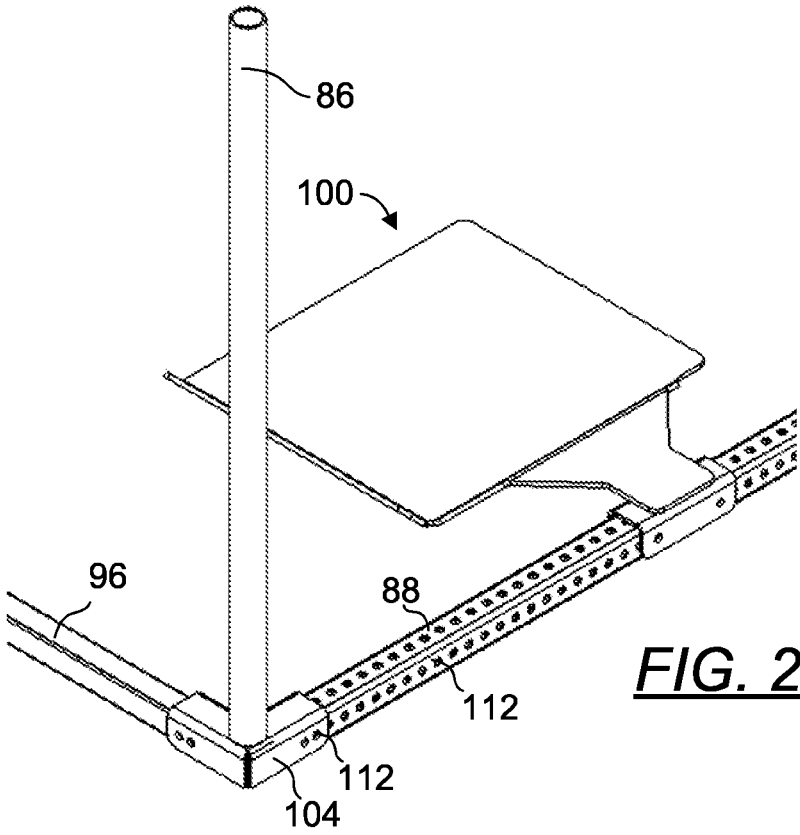
FIG. 25 is a partial top perspective view of a distal post and a corner channel to which the distal post is attached.
Figure 26:
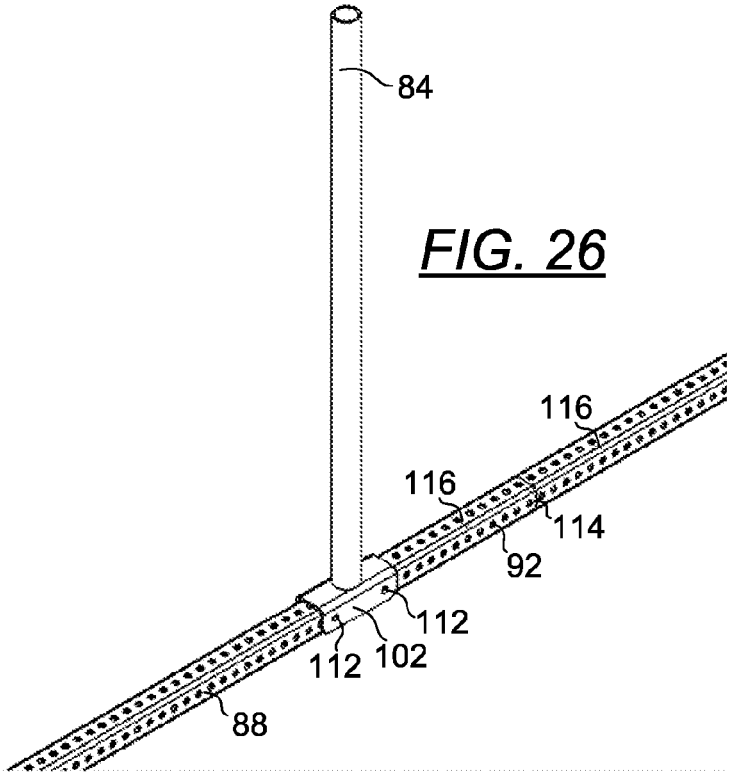
FIG. 26 is a partial top perspective view of a medial post and a side channel to which the medial post is attached.

FIG. 25 is a partial top perspective view of a distal post and a corner channel 104 to which the distal post 86 is attached. The distal post 86 includes a top end and a bottom end and it is secured at its bottom end to the corner channel 104. The corner channel 104 is essentially a right angled inverted channel which connects a side and corner frame 88 to the distal cross bar 96. FIG. 26 is a partial top perspective view of a medial post 84 and a side channel 102 to which the medial post 84 is attached. This figure further shows the use of extension block 92 to connect two side and corner frames 88 together. An extension block 92 is inserted in the cavities of two opposingly disposed side and corner frames 88 which meet at point 114. Points 116 mark the ends of extension block 92. The position of a medial post 84 relative to the bottom frame can be simply adjusted by sliding the side channel to which the medial post 84 is attached along a side and corner frame 88 or an extension frame 90. The adjustability of medial post positioning enables opening and closing of the driver side and/or passenger side door/doors without interference.

Figure 27:
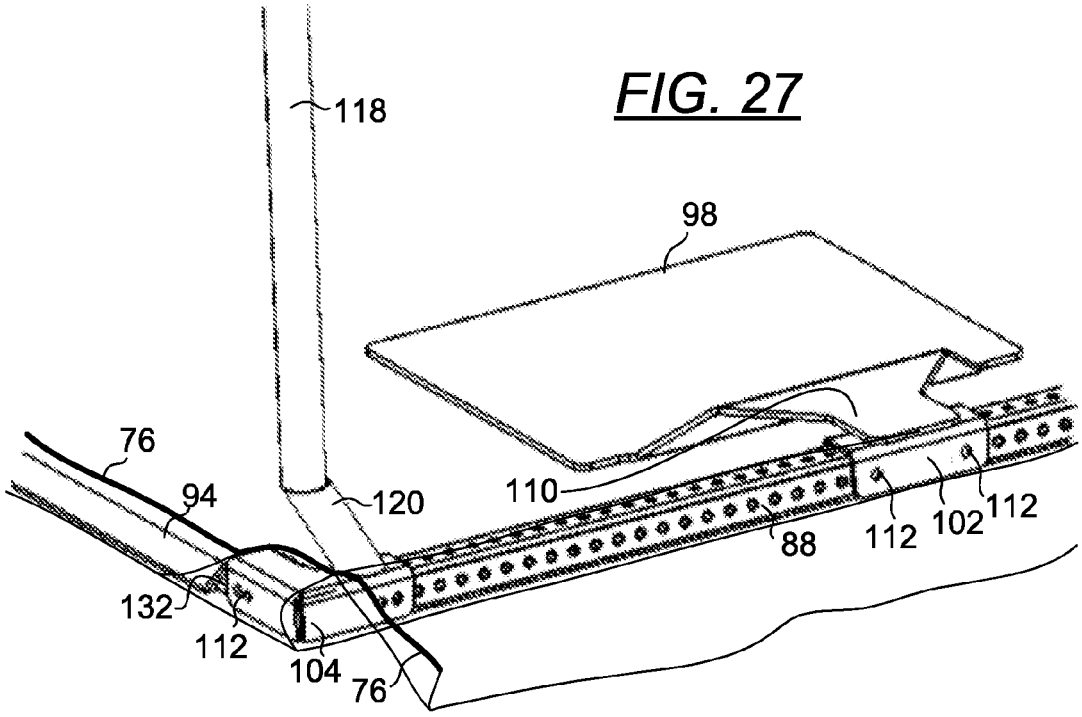
FIG. 27 is a partial top perspective view of a proximal corner of the embodiment of FIG. 21 with the flexible enclosure opened.
Figure 28:
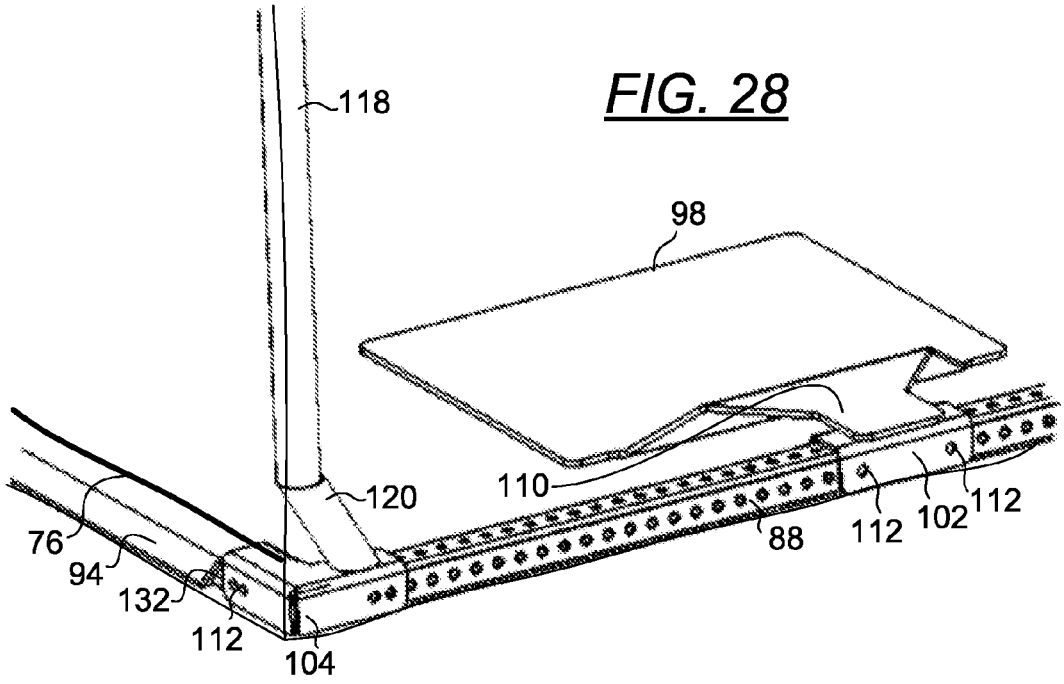
FIG. 28 is a partial top perspective view of a proximal corner of the embodiment of FIG. 21 with the flexible enclosure closed.

FIG. 27 is a partial top perspective view of a proximal weigh down plate 98 of the embodiment of FIG. 19 with the flexible enclosure opened. The proximal post includes a vertical portion 118 and an inclined portion 120 where the inclined portion is attached to a corner channel 104. The corner channel connects the proximal cross bar 94 to a side and corner frame 88. The concave surface made available by the inclined portion 120 allows the portion of the flexible enclosure below the closing means to be pressed flat onto the proximal cross bar 94 when a vehicle enters the proximal portion 140 of the vehicle enclosure 73. As a result, tensioning of the flexible enclosure against the proximal post 82 is avoided. The vertical portion 118 of the proximal post 82 is disposed as close to a corner of the bottom frame as possible to ensure that the flexible enclosure 74 is deployed as tautly as possible against the support frame system 81 as shown in FIG. 28.

Figure 29:
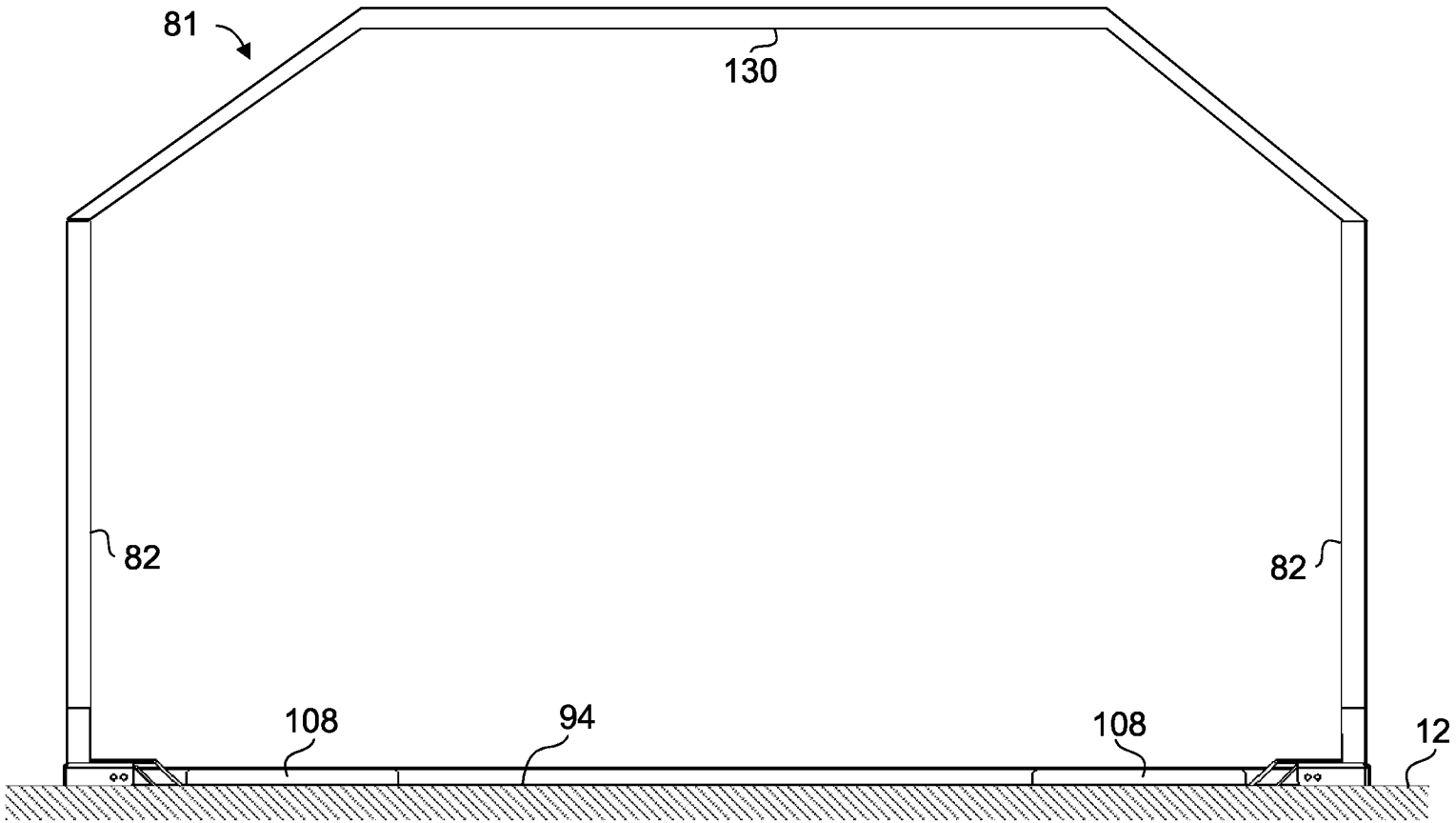
FIG. 29 is a front orthogonal view of the support frame system of FIG. 19.

FIG. 29 is a front orthogonal view of the support frame system of FIG. 19, depicting a proximal cross bar which lays flat on the floor 12 on which the support frame system 81 is disposed to enable entry or exit of a vehicle to be stored in the support frame system 81. This figure further shows the protrusion of lips 108 of the distal weigh down plates 100 from the floor 12 level for marking the travel limit of a vehicle to be stored in the support frame system 81.

I claim:

1. A portable passive anti-corrosion vehicle enclosure configured for protectedly storing a vehicle having a body on a floor, said vehicle enclosure comprising:

a flexible enclosure defining a volume sufficient for storing vehicle in its entirety, said flexible enclosure comprising a floor sheet having a periphery, a closed ended side sheet having a top periphery and a bottom periphery, a ceiling sheet having a periphery and a closing means, wherein said side sheet is fixedly attached at said bottom periphery to said periphery of said floor sheet, said side sheet is fixedly attached at said top periphery to said periphery of said ceiling sheet and said closing means is disposed on a portion of said side sheet at an offset from said floor sheet and substantially parallelly from said periphery of said floor sheet, wherein said closing means is configured for providing access of said volume for storing said vehicle and isolating said volume from its surrounding environment; and a support frame system disposed within said flexible enclosure for supporting said flexible enclosure such that no part of said vehicle enclosure comes in contacting engagement with the body of the vehicle, thereby not compromising the finish of the body of the vehicle.

2. The portable passive anti-corrosion vehicle enclosure of claim 1, wherein said flexible enclosure is vapor phase corrosion inhibitor (VPCI) impregnated.

3. The portable passive anti-corrosion vehicle enclosure of claim 1, further comprising at least one individual packet containing and capable of releasing VPCI materials disposed in said volume.

4. The portable passive anti-corrosion vehicle enclosure of claim 1, wherein said offset is about 6 inches.

5. A portable passive anti-corrosion vehicle enclosure configured for protectedly storing a vehicle having a body on a floor, said vehicle enclosure comprising:

(a) a support frame system defining a volume, said support frame system comprising:

(i) a bottom frame capable of being sized to accommodate the vehicle;

(ii) a plurality of vertically disposed posts, each post having a top end and a bottom end, wherein each post is secured at its bottom end to said bottom frame and a number of said vertically disposed posts are capable of position adjustment along said bottom frame and;

(iii) a plurality of support bars, each bar is secured at each end to a top end of one of said plurality of vertically disposed posts; and (iv) at least one weigh down plate secured to said bottom frame, wherein said at least one weigh down plate is capable of position adjustment along said bottom frame, said at least one weigh down plate is configured to be disposed under at least a portion of the weight of the vehicle and said at least one weigh down plate further comprises a lip disposed at one edge of said at least one weigh down plate, wherein said lip is configured to mark a travel limit for the vehicle positioned inside said vehicle enclosure; and (b) a flexible enclosure comprising a closing means, wherein said closing means is disposed at an offset from the floor, wherein said support frame system is disposed within said flexible enclosure and configured for supporting said flexible enclosure and said closing means is configured to enclose said volume to isolate said volume from its surrounding environment and that no part of said vehicle enclosure comes in contacting engagement with the body of the vehicle, thereby not compromising the finish of the body of the vehicle.

6. The portable passive anti-corrosion vehicle enclosure of claim 5, wherein said flexible enclosure is vapor phase corrosion inhibitor (VPCI) impregnated.

7. The portable passive anti-corrosion vehicle enclosure of claim 5, further comprising at least one individual packet containing and capable of releasing VPCI materials disposed in said volume.

8. The portable passive anti-corrosion vehicle enclosure of claim 5, wherein at least a pair of said plurality of vertically disposed posts comprises a concave surface configured to receive a portion of said flexible enclosure below said closing means to avoid tensioning of said flexible enclosure when the vehicle enters or exits said support frame system.

9. The portable passive anti-corrosion vehicle enclosure of claim 5, wherein said offset is about 6 inches.

10. The portable passive anti-corrosion vehicle enclosure of claim 5, wherein said closing means is a waterproof zipper.

11. The portable passive anti-corrosion vehicle enclosure of claim 5, wherein at least a pair of said plurality of vertically disposed posts comprises a concave surface configured to receive a portion of said flexible enclosure below said closing means to avoid tensioning of said flexible enclosure when the vehicle enters said support frame system.

12. A portable passive anti-corrosion vehicle enclosure configured for protectedly storing a vehicle having a body on a floor, said vehicle enclosure comprising:

(a) a support frame system defining a volume, said support frame system comprising:

(i) a bottom frame capable of being sized to accommodate the vehicle;

(ii) a plurality of vertically disposed posts, each post having a top end and a bottom end, wherein each post is secured at its bottom end to said bottom frame and a number of said vertically disposed posts are capable of position adjustment along said bottom frame and;

(iii) a plurality of support bars, each bar is secured at each end to a top end of one of said plurality of vertically disposed posts; and (iv) at least one weigh down plate secured to said bottom frame, wherein said at least one weigh down plate is capable of position adjustment along said bottom frame and said at least one weigh down plate is configured to be disposed under at least a portion of the weight of the vehicle; and (b) a flexible enclosure comprising a floor sheet having a periphery, a closed ended side sheet having a top periphery and a bottom periphery, a ceiling sheet having a periphery and a closing means, wherein said side sheet is fixedly attached at said bottom periphery to said periphery of said floor sheet, said side sheet is fixedly attached at said top periphery to said periphery of said ceiling sheet and said closing means is disposed on a portion of said side sheet at an offset from said floor sheet and substantially parallelly from said periphery of said floor sheet, wherein said support frame system is disposed within said flexible enclosure and configured for supporting said flexible enclosure and said closing means is configured to enclose said volume to isolate said volume from its surrounding environment and that no part of said vehicle enclosure comes in contacting engaugement with the body of the vehicle, thereby not compromising the finish of the body of the vehicle.

13. The portable passive anti-corrosion vehicle enclosure of claim 12, wherein said at least one weigh down plate further comprises a lip disposed at one edge of said at least one weigh down plate, wherein said lip is configured to mark a travel limit for the vehicle positioned inside said vehicle enclosure.

14. The portable passive anti-corrosion vehicle enclosure of claim 12, wherein said flexible enclosure is vapor phase corrosion inhibitor (VPCI) impregnated.

15. The portable passive anti-corrosion vehicle enclosure of claim 12, further comprising at least one individual packet containing and capable of releasing VPCI materials disposed in said volume.

16. The portable passive anti-corrosion vehicle enclosure of claim 12, wherein at least a pair of said plurality of vertically disposed posts comprises a concave surface configured to receive a portion of said flexible enclosure below said closing means to avoid tensioning of said flexible enclosure when the vehicle enters said support frame system.

17. The portable passive anti-corrosion vehicle enclosure of claim 12, wherein said offset is about 6 inches.

18. The portable passive anti-corrosion vehicle enclosure of claim 12, wherein said closing means is a waterproof zipper.

* * * * *